United States Patent [19]

Ohki et al.

[11] Patent Number: 4,920,041

[45] Date of Patent: Apr. 24, 1990

[54] METHOD FOR PROCESSING A SILVER HALIDE COLOR PHOTOGRAPHIC MATERIAL USING A DEVELOPER SUBSTANTIALLY FREE OF BENZYL ALCOHOL AND SULFITE

[75] Inventors: Nobutaka Ohki; Kazuto Andoh; Takatoshi Ishikawa, all of Kanagawa, Japan

[73] Assignee: Fuji Photo Film Co., Ltd., Kanagawa, Japan

[21] Appl. No.: 298,238

[22] Filed: Jan. 12, 1989

Related U.S. Application Data

[63] Continuation of Ser. No. 82,455, Aug. 7, 1987, abandoned.

[30] Foreign Application Priority Data

Aug. 7, 1986 [JP] Japan ..... 61-184328

[51] Int. Cl.[5] ..... G03C 7/30; G03C 7/00

[52] U.S. Cl. ..... 430/380; 430/434; 430/464; 430/467; 430/484; 430/490

[58] Field of Search ..... 430/464, 467, 490, 372, 430/380, 377, 434, 484

[56] References Cited

U.S. PATENT DOCUMENTS

| | | | |
|---|---|---|---|
| 2,193,015 | 5/1939 | Weissberger et al. | 430/470 |
| 3,615,503 | 10/1971 | Edens | 430/467 |
| 3,767,411 | 10/1973 | Kishimoto et al. | 430/484 |
| 4,170,478 | 10/1979 | Case et al. | 430/467 |
| 4,298,681 | 11/1981 | Balloch et al. | 430/484 |
| 4,500,635 | 2/1985 | Aoki et al. | 430/552 |
| 4,748,100 | 5/1988 | Umemoto et al. | 430/505 |
| 4,774,167 | 9/1988 | Koshimizga et al. | 430/467 |

FOREIGN PATENT DOCUMENTS

| | | |
|---|---|---|
| 158446 | 9/1985 | Japan . |
| 1306176 | 2/1973 | United Kingdom . |

*Primary Examiner*—Charles L. Bowers, Jr.

*Assistant Examiner*—Patrick A. Doody

*Attorney, Agent, or Firm*—Sughrue, Mion, Zinn, Macpeak & Seas

[57] ABSTRACT

A method for processing a silver halide color photographic material comprising a reflective support having thereon at least one light-sensitive silver halide emulsion layer containing a color coupler or color couplers, which comprises the step of, after imagewise exposing, developing said silver halide color photographic material with a color developing solution which does not substantially contain benzyl alcohol and which contains an aromatic primary amine color developing agent represented by formula (A):

(A)

wherein X represents a compound capable of forming a salt with a primary amine; and a compound represented by formula (I):

(I)

wherein $R^1$ represents a hydrogen atom or a substituted or unsubstituted alkyl, aryl, alkoxy, aryloxy or amino group; and $R^2$ represents a hydrogen atom or a substituted or unsubstituted alkyl or aryl group; or $R^1$ and $R^2$ may be bonded to each other to form a carbon ring or a hetero-ring.

The color developing solution used in the present method has improved stability and color forming properties.

26 Claims, No Drawings

METHOD FOR PROCESSING A SILVER HALIDE COLOR PHOTOGRAPHIC MATERIAL USING A DEVELOPER SUBSTANTIALLY FREE OF BENZYL ALCOHOL AND SULFITE

This a continuation of application Ser. No. 07/082,455, filed Aug. 7, 1987, now abandoned.

FIELD OF THE INVENTION

The present invention relates to a method for processing a silver halide color photographic material, and more particularly, the invention relates to a method for processing a silver halide color photographic material which has improved stability and color forming properties of a color developing solution and which reduces fog during continuous processing.

BACKGROUND OF THE INVENTION

Color developing solutions containing an aromatic primary amine color developing agent have been conventionally used in methods for forming color images and principally used in methods for forming color images in color photographs at present. However, these color developing solutions have a problem in that these are easily oxidized by air or in the presence of metals, and it is well known that when color images are formed by the use of an oxidized developing solution, an undesirable increase in fog and changes in sensitivity and gradation occur, and the photographic characteristics differ from those desired.

Accordingly, various methods for improving the preservability of color developing solutions have been investigated. Among them, a method in which a hydroxylamine and sulfite ion are used together is most commonly employed.

Further, in order to increase the stability of color developing solutions, various preservatives and chelating agents have been investigated. Such preservatives include aromatic polyhydroxy compounds as described in Japanese Patent Application (OPI) Nos. 49828/77, 160142/84 and 47038/81 (the term "OPI" as used herein refers to a "published unexamined Japanese patent application"), and U.S. Pat. No. 3,746,544,.etc.; hydroxycarbonyl compounds as described in U.S. Pat. No. 3,615,503 and British Pat. No. 1,306,176, etc.; α-aminocarbonyl compounds as described in Japanese Patent Application (OPI) Nos. 143020/77 and 89425/78, etc.; alkanolamines as described in Japanese Patent Application (OPI) No. 3532/79, etc.; and metal salts as described in Japanese Patent Application (OPI) Nos. 44148/82 and 53749/82, etc. Also chelating agents include aminopolycarboxylic acids as described in Japanese Patent Publication Nos. 30496/73 and 30232/69, etc.; organic phosphonic acids as described in Japanese Patent Application (OPI) No. 97347/81, Japanese Patent Publication No. 39359/81, and West German Pat. No. 2,227,639, etc.; phosphonocarboxylic acids as described in Japanese Patent Application (OPI) Nos. 102726/77, 42730/78, 121127/79, 126241/80, and 65956/80, etc.; and compounds described in Japanese Patent Application (OPI) Nos. 195845/83 and 203440/83, and Japanese Patent Publication No. 40900/78, etc.

However, hydroxylamines have a problem in that these generate ammonia by decomposition to cause the generation of fogs; and in addition, sulfite ions have a defect in that these competitively react with developing agents to injure the color forming properties of the agents. Accordingly, both of these agents cannot be said to be a favorable preservative. In addition, other preservatives are insufficient in the preservability or competitively react with developing agents to affect adversely the photographic characteristics such as sensitivity, and gradation, etc., and therefore, any satisfactory effect could not be attained as yet.

On the other hand, benzyl alcohol which is extremely effective as a color formation accelerator for color developing agents has widely been used in developing solutions for color photographic papers, and the use of the benzyl alcohol is an effective means for solving the problem of hindrance to the color forming properties, brought about by preservatives such as sulfite ions. However, the benzyl alcohol has various problems including environmental pollution and difficulty in the preparation of solutions. Accordingly, it is desired to develop some other technical means to avoid the use of benzyl alcohol.

However, the color forming properties of color developing solutions not containing the benzyl alcohol, which is a color formation accelerator, is inevitably deteriorated. Further, when conventional preservatives are used in such system containing no benzyl alcohol, some further extreme deterioration of the color forming properties of the color developing solutions would be presumed since most of conventional preservatives competitively react with developing agents to cause hindrance to the color formation.

In particular, the color formation of color photographic papers containing silver chlorobromide emulsions with high chlorine content is often hindered with during color development and these often have noticeable fog as described in Japanese Patent Application (OPI) Nos. 95345/83 and232342/84. Accordingly, in the use of such emulsions, the addition of some preservative which is hardly soluble in the emulsions and which has an excellent preservability even when no benzyl alcohol is used, is desired. However, such preservative has not been found as yet.

SUMMARY OF THE INVENTION

Therefore, an object of the present invention is to provide a method for processing a silver halide color photographic material, which has improved stability with the use of a color developing solution which does not substantially contain benzyl alcohol and which restrains fog formation during continuous processing.

Another object of the present invention is to provide a method for processing a silver halide color photographic material, which has improved stability and color forming properties even when that is processed with a color developing solution which does not substantially contain benzyl alcohol.

It has now been found that these objects of the present invention can be obtained by a method for processing a silver halide color photographic material comprising a reflective support having thereon at least one light-sensitive silver halide emulsion layer containing a color coupler or color couplers, which comprises the step of developing the silver halide color photographic material, after imagewise exposing, with a color developing solution which does not substantially contain benzyl alcohol and which contains an aromatic primary amine color developing agent represented by formula (A):

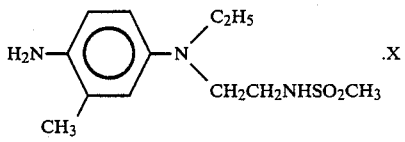

(A)

wherein X represents a compound capable of forming a salt with a primary amine; and a compound represented by formula (I):

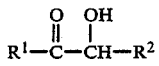

(I)

wherein $R^1$ represents a hydrogen atom or a substituted or unsubstituted alkyl, aryl, alkoxy, aryloxy or amino group; $R^2$ represents a hydrogen atom or a substituted or unsubstituted alkyl or aryl group; or $R^1$ and $R^2$ may be bonded to each other to form a carbon ring or a hetero-ring.

According to one preferred embodiment of the method of the invention, the silver halide color photographic material contains at least one cyan coupler represented by formula (C-1):

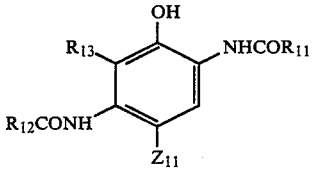

(C-I)

wherein $R_{11}$ represents an alkyl group, a cycloalkyl group, an aryl group, an amino group or a heterocyclic group; $R_{12}$ represents an alkyl group or an aryl group; $R_{13}$ represents a hydrogen atom, a halogen atom, an alkyl group or an alkoxy group; or $R_{13}$ may be bonded to $R_{12}$ to form a ring; $Z_{11}$ represents a hydrogen atom, a halogen atom or a group capable of being released by the reaction with the oxidation product of an aromatic primary amine color developing agent; and formula (C-II):

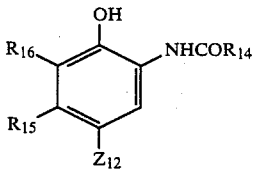

(C-II)

wherein $R_{14}$ represents an alkyl group, a cycloalkyl group, an aryl group or a heterocyclic group; $R_{15}$ represents an alkyl group having 2 or more carbon atoms; $R_{16}$ represents a hydrogen atom, a halogen atom or an alkyl group; and $Z_{12}$ represents a hydrogen atom, a halogen atom or a group capable of being released by the reaction with the oxidation product of an aromatic primary amine color developing agent.

DETAILED DESCRIPTION OF THE INVENTION

The means of adding the compound of formula (I) to a color developing solution for improving the stability of the developing solution is described in U.S. Pat. No. 3,615,503. However, any satisfactory stability could not be attained by the means only as described in this patent. Accordingly, it is quite surprising that the use of the compound of formula (I) only in combination with the specific developing agent of formula (A) in a color developing system substantially not containing benzyl alcohol, which is a color forming accelerator, in accordance with the method of the present invention is effective for extremely improving the stability of the color developing solution and for preventing the generation of fog in the photographic materials processed, which is one inventive aspect of the present invention.

The cyan couplers of formulae (C-I) and (C-II) are known,as described in Japanese Patent Application (OPI) No. 166956/84, and Japanese Patent Publication No. 11572/74, etc. However, these cyan couplers are effective for remarkably reducing the generation of fog in the photographic materials processed by continuous processing only when these are used together with the specific compound of formula (I) in accordance with the present invention, and the combination of the cyan coupler(s) of formulae (C-I) and (C-II) and the compound of formula (I) in continuous processing is another inventive aspect of the present invention.

Next, the color developing agents for use in the present invention are explained in detail hereinafter.

The color developing agents for use in the present invention have the following structural formula (A):

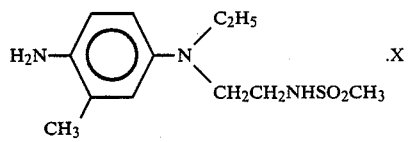

(A)

wherein X represents a compound capable of forming a salt with a primary amine. Specific examples of such compounds are sulfates, hydrochlorides, oxalates, phosphates, p-toluenesulfonates, nitrates, etc., which are, however, not limitative.

The amount of the color developing agent represented by formula (I) to be used is preferably from about 0.1 g to about 20 g, and more preferably from about 0.5 g to about 10 g, per liter of the color developing solution.

The compounds of the formula (I) to be used in the present invention will now be explained in detail.

The compounds of the present invention are those represented by formula (I):

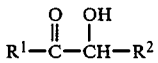

(I)

wherein $R^1$ represents a hydrogen atom, a substituted or unsubstituted alkyl group (preferably having from 1 to 10 carbon atoms, such as a methyl group, an ethyl group, a hydroxymethyl group, a methoxyethyl group, a cyclohexyl group, etc.), a substituted or unsubstituted aryl group (preferably having from 6 to 10 carbon atoms, such as a phenyl group, a 2-hydroxyphenyl group, etc.), a substituted or unsubstituted alkoxy group (preferably having from 1 to 10 carbon atoms, such as a methoxy group, an ethoxy group, a butoxy group, a methoxyethoxy group, etc.), a substituted or unsubstituted aryloxy group (preferably having from 6 to 10 carbon atoms, such as a phenoxy group, a 4-methoxyphenoxy group, etc.) or a substituted or unsubstituted amino group (preferably having from 0 to 10 carbon atoms, such as an amino group, an N,N-diethylamino group, an N,N-dipropylamino group, etc.); $R^2$ represents a hydrogen atom, a substituted or unsubstituted alkyl group (preferably having from 1 to 10 carbon atoms, such as a methyl group, an ethyl group, a hydroxymethyl group, etc.) or a substituted or unsubstituted aryl group (preferably having from 6 to 10 carbon atoms, such as a phenyl group, a 2-hydroxyphenyl group, etc.); and $R^1$ and $R^2$ may be bonded to each other to form a carbon ring or a hetero-ring.

As the substituents by which the groups of $R^1$ and $R^2$ can further be substituted, those having a relatively high water-solubility are especially preferred, including, for example, a hydroxyl group, a sulfo group, a carboxyl group, an alkoxy group, a halogen atom, a sulfonamido group, etc.

In formula (I), $R^1$ is preferably an alkyl group, an alkoxy group or an amino group, most preferably an alkyl group.

In formula (I), $R^2$ is preferably a hydrogen atom or an alkyl group.

Specific examples of the compounds of formula (I) are set forth below, but the present invention is not to be construed as being limited thereto.

(1) $CH_3\overset{O}{\overset{\|}{C}}CH_2OH$ (2) $HO\overset{O}{\overset{\|}{C}}H_2CH_2OH$ (and dimer thereof)

(3) $CH_3\overset{O}{\overset{\|}{C}}-\overset{OH}{\overset{|}{C}}HCH_3$ (4) $H\overset{O}{\overset{\|}{C}}-CH_2OH$ (5) $H\overset{O}{\overset{\|}{C}}-\overset{OH}{\overset{|}{C}}HCH_2OH$ (6) 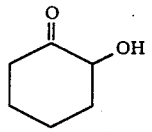

(7) $CH_3O\overset{O}{\overset{\|}{C}}-\overset{OH}{\overset{|}{C}}HCH_2H_5$ (8) 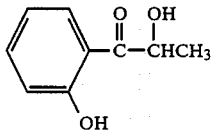

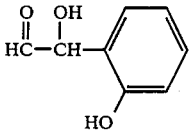

(10) 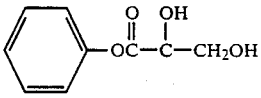

-continued

(11) 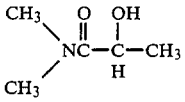

(12) 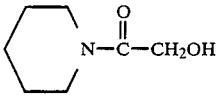

(13) $C_2H_5O\overset{O}{\overset{\|}{C}}CH_2OH$

(14) 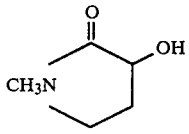

(15) $C_3H_7\overset{O}{\overset{\|}{C}}-CH_2OH$

(16) $CH_3OCH_2CH_2O\overset{O}{\overset{\|}{C}}-\overset{OH}{\overset{|}{C}}HCH_3$

(17) $CH_3\overset{O}{\overset{\|}{C}}-\overset{OH}{\overset{|}{C}}HC_4H_9$

(18) $CH_3SO_2NHCH_2\overset{O}{\overset{\|}{C}}-\overset{OH}{\overset{|}{C}}HC_2H_5$ Most of the compounds of formula (I) are available as commercial products. Further, the compounds can be synthesized by known methods as described in, John Wiley & Sons, Inc., *Organic Syntheses,* Col. 1, Vol. 2, page 5.

The amount of the compound represented by formula (I) to be added to a color developing solution is preferably from about 0.1 g to 20 g, and more preferably from about 0.5 g to 10 g, per liter of the color developing solution.

The cyan couplers of formulae (C-I) and (C-II) to be used in the present invention will now be explained in detail.

The cyan couplers of the present invention are those represented by formulae (C-I) and (C-II):

(C-I) 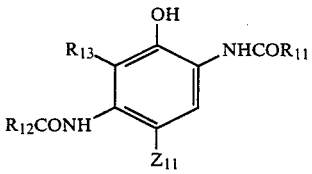

wherein $R_{11}$ represents an alkyl group, a cycloalkyl group, an aryl group, an amino group or a heterocyclic group; $R_{12}$ represents an alkyl group or an aryl group; $R_{13}$ represents a hydrogen atom, a halogen atom, an alkyl group or an alkoxy group; $R_{13}$ may be bonded to $R_{12}$ to form a ring; and $Z_{11}$ represents a hydrogen atom, a halogen atom or a group capable of being released by the reaction with the oxidation product of an aromatic primary amine color developing agent;

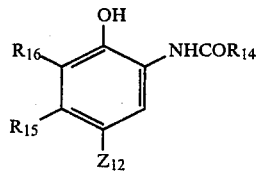

(C-II)

wherein $R_{14}$ represents an alkyl group, a cycloalkyl group, an aryl group or a heterocyclic group; $R_{15}$ represents an alkyl group having 2 or more carbon atoms; $R_{16}$ represents a hydrogen atom, a halogen atom or an alkyl group; and $Z_{12}$ represents a hydrogen atom, a halogen atom or a group capable of being released by the reaction with the oxidation product of an aromatic primary amine color developing agent.

In the cyan couplers of formulae (C-I) and (C-II), the alkyl group (including the cycloalkyl group) having from 1 to 32 carbon atoms for the groups $R_{11}$, $R_{12}$ and $R_{14}$ includes, for example, a methyl group, a butyl group, a tridecyl group, a cyclohexyl group, an allyl group, etc.; the aryl group includes, for example, a phenyl group, a naphthyl group, etc.; and the heterocyclic group includes, for example, a 2-pyridyl group, a 2-imidazolyl group, a 2-furyl group, a 6-quinolyl group, etc. These groups may further be substituted by substituent(s) selected from an alkyl group, an aryl group, a heterocyclic group, an alkoxy group (e.g., a methoxy group, a 2-methoxyethoxy group, etc.), an aryloxy group (e.g., a 2,4-di-tert-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluene-sulfonyloxy group, etc.), an amido group (e.g., an acetylamino group, a methanesulfonylamido group, a dipropylsulfamoylamino group, etc.), a carbamoyl group (e.g., a dimethylcarbamoyl group, an ethylcarbamoyl group, etc.), a sulfamoyl group (e.g., a butylsulfamoyl group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl group, etc.), an aliphatic- or aromatic-thio group (e.g., an ethylthio group, a phenylthio group, etc.), a hydroxyl group, a cyano group, a carboxyl group, a nitro group, a sulfo group, a halogen atom, etc.

The alkyl group of $R_{13}$ and $R_{16}$ includes, for example, a methyl group, an ethyl group, a butyl group, a cyclohexyl group, an allyl group, etc.

The amino group of $R_{11}$ may be substituted or unsubstituted. As the substituents for the substituted amino groups, the above-mentioned substituents for the alkyl group of formulae (C-I) and (C-II) can be used. Specific examples of the substituted amino group of $R_{11}$ are an anilino group, a benzothiazolylamino group, etc.

In formula (C-I), when $R_{13}$ represents a substituted group, the group can be substituted by the optionally substituted substituents as referred to in the group of $R_{11}$.

As the alkyl group having at least two or more carbon atoms for the group $R_{15}$ in formula (C-II), there may be mentioned, for example, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group, a methoxymethyl group, etc.

In formulae (C-I) and (C-II), $Z_{11}$ and $Z_{12}$ each represent a hydrogen atom or a coupling off group (including a coupling off atom). Specific examples of such groups are a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphaticor aromatic-thio group (e.g., an ethylthio group, a phenylthio group, a tetrazolylthio group, etc.), an imido group (e.g., a succinimido group, a hydantoinyl group, etc.), an aromatic azo group (e.g., a phenylazo group, etc.), etc. These coupling off groups can contain a photographically useful group.

Preferred examples of the cyan couplers of formulae (C-I) and (C-II) are as follows:

In formula (C-I), $R_{11}$ is preferably an aryl group or a heterocyclic group, and is more preferably an aryl group substituted by substituent(s) selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, a hydroxycarbonyl group and a cyano group.

In formula (C-I), when $R_{13}$ and $R_{12}$ do not form a ring, $R_{12}$ is preferably a substituted or unsubstituted alkyl or aryl group, and is more preferably an alkyl group substituted by a substituted aryloxy group, and $R_{13}$ is preferably a hydrogen atom.

In formula (C-II), $R_{14}$ is preferably a substituted or unsubstituted alkyl or aryl group, and is more preferably an alkyl group substituted by a substituted aryloxy group.

In formula (C-II), $R_{15}$ is preferably an alkyl group having from 2 to 15 carbon atoms or a methyl group substituted by a substituent having 1 or more carbon atoms. As the substituent, an arylthio group, an alkylthio group, an acylamino group, an aryloxy group or an alkyloxy group is preferred.

In formula (C-II), $R_{15}$ is more preferably an alkyl group having from 2 to 15 carbon atoms, and is most preferably an alkyl group having from 2 to 4 carbon atoms.

In formula (C-II), $R_{16}$ is preferably a hydrogen atom or a halogen atom, and is more preferably a chlorine atom or a fluorine atom.

In formulae (C-I) and (C-II), $Z_{11}$ and $Z_{12}$ each are preferably a hydrogen atom, a halogen atom, an alkoxy group, an aryloxy group, an acyloxy group or a sulfonamido group.

In formula (C-II), $Z_{12}$ is preferably a halogen atom, and is more preferably a chlorine atom or a fluorine atom.

In formula (C-I), $Z_{11}$ is preferably a halogen atom,and is more preferably a chlorine atom or a fluorine atom.

In formulae (C-I) and (C-II), each carbon atom number contained in $R_{11}$, $R_{12}$, $R_{13}$, $R_{14}$, $R_{15}$, or $R_{16}$ is preferably 60 or less, more preferably 40 or less, and particularly preferably 20 or less, respectively.

Specific examples of the cyan couplers of formulae (C-I) and (C-II) are set forth below, but the present invention is not to be construed as being limited thereto.

(C-1)

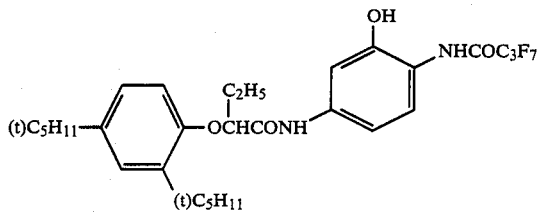

(C-2)

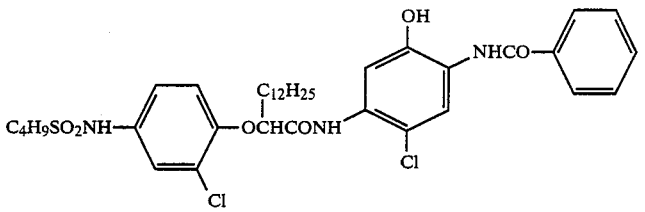

(C-3)

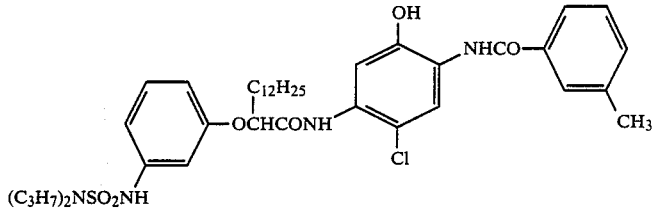

(C-4)

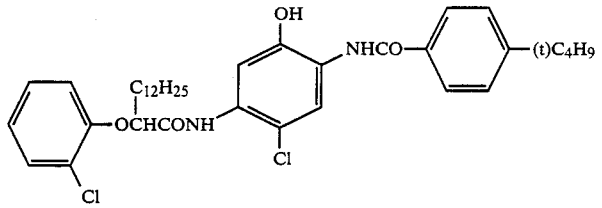

(C-5)

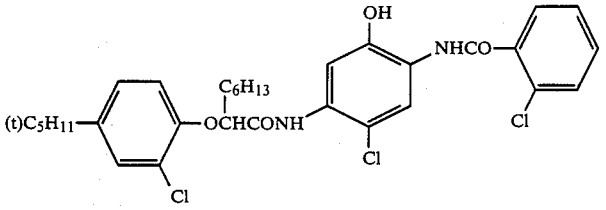

(C-6)

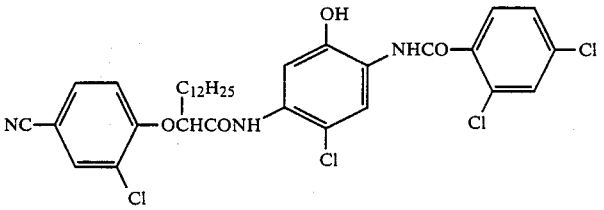

-continued
(C-7)
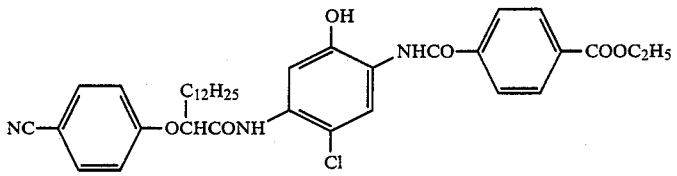
(C-8)
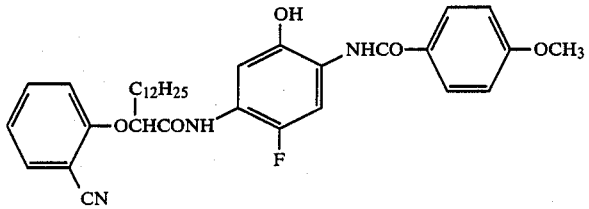
(C-9)
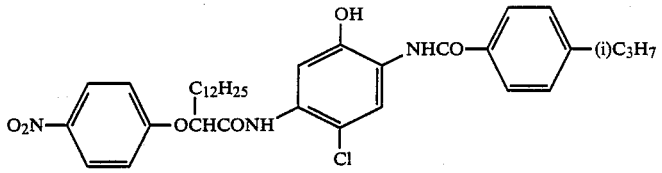
(C-10)
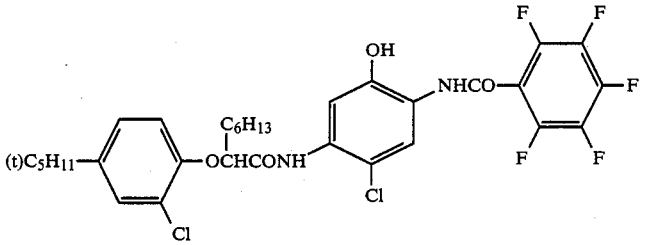
(C-11)
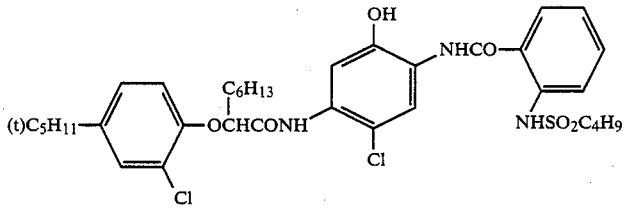
(C-12)
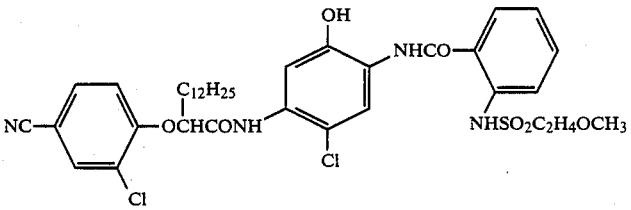
(C-13)
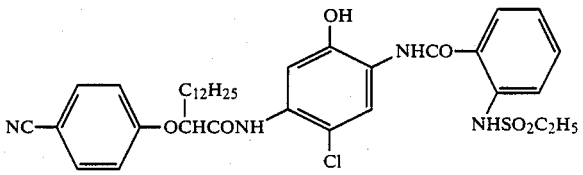

-continued
(C-14)
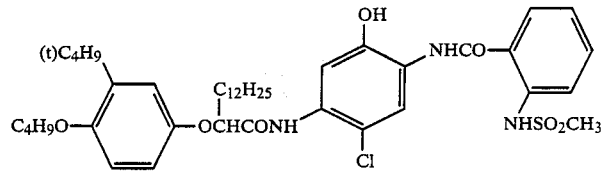
(C-15)
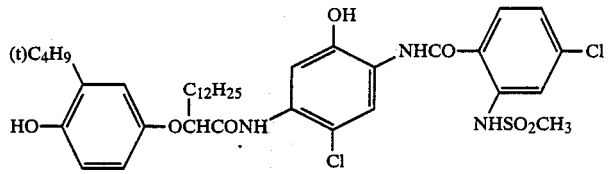
(C-16)
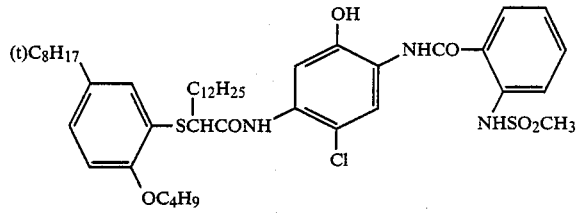
(C-17)
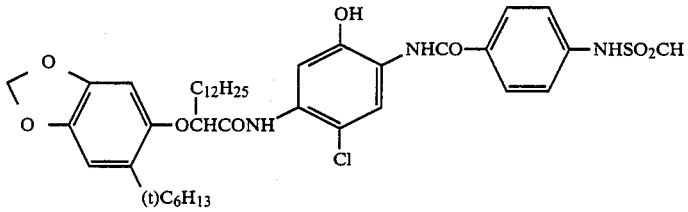
(C-18)
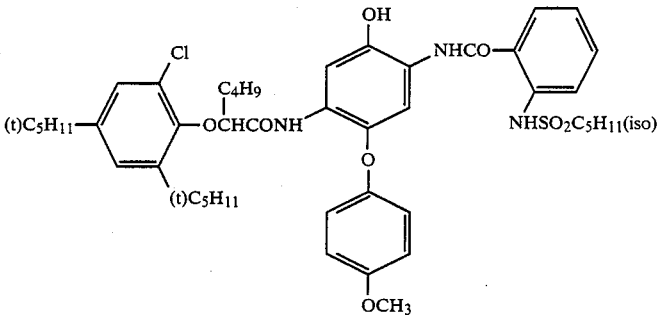
(C-19)
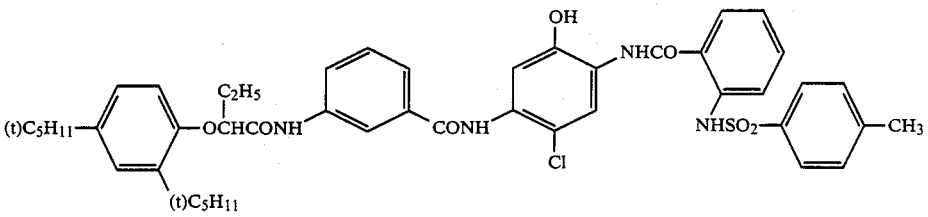
(C-20)
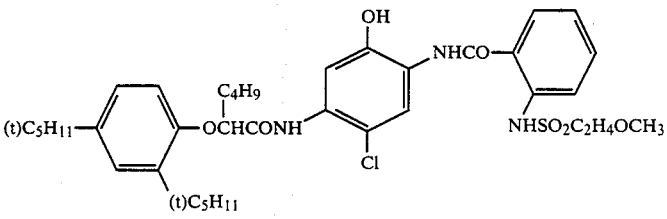

-continued
(C-21)
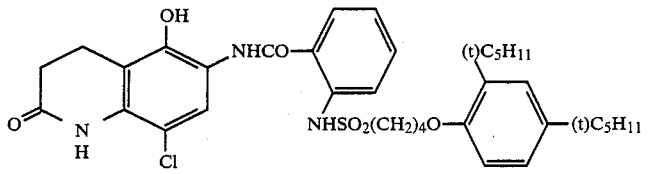
(C-22)
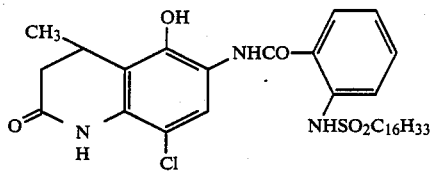
(C-23)
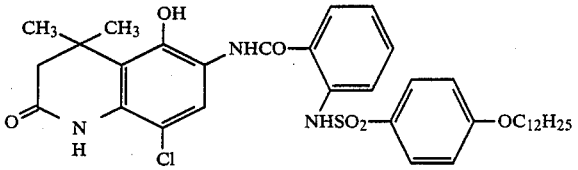
(C-24)
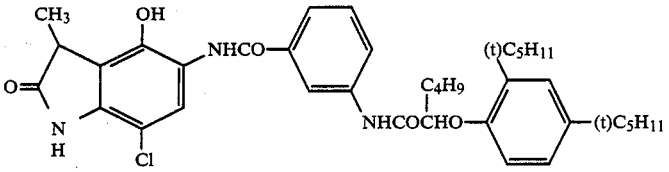
(C-25)
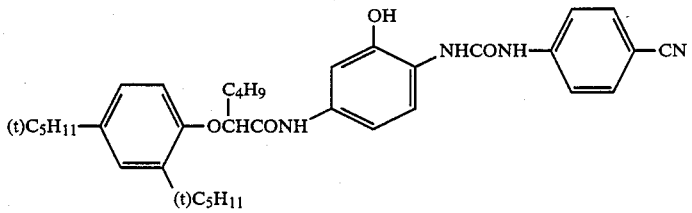
(C-26)
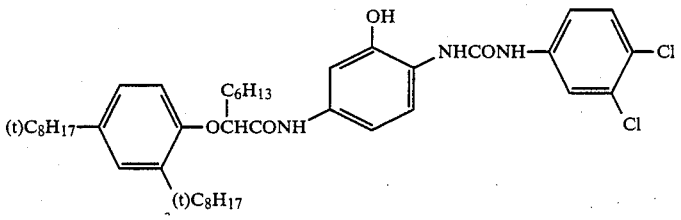
(C-27)
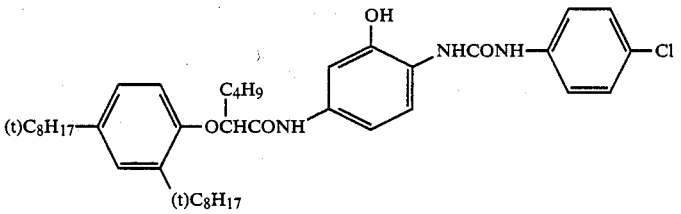
(C-28)
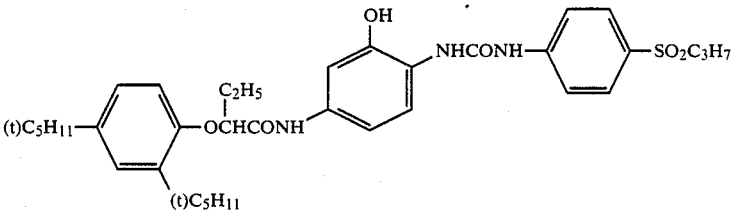

-continued
(C-29)
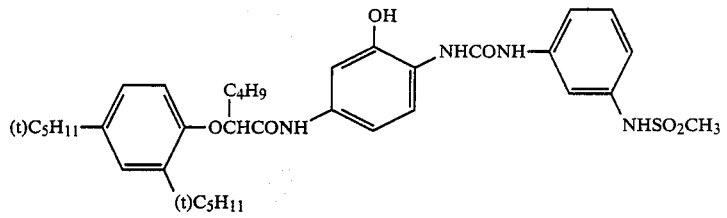
(C-30)
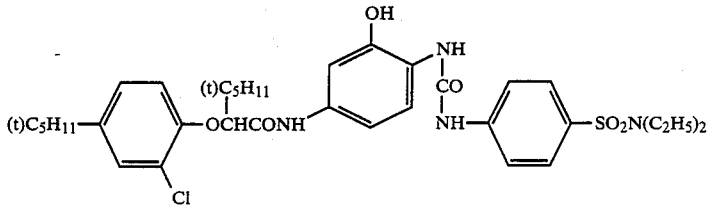
(C-31)
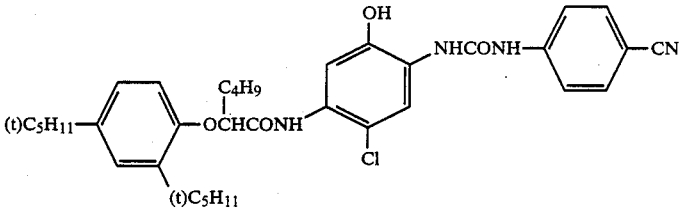
(C-32)
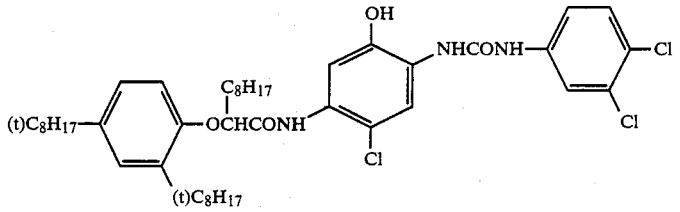
(C-33)
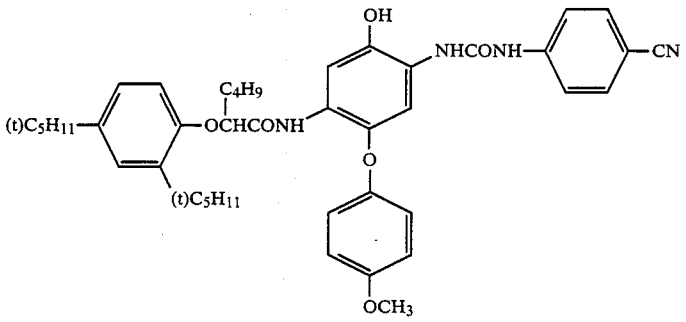
(C-34)
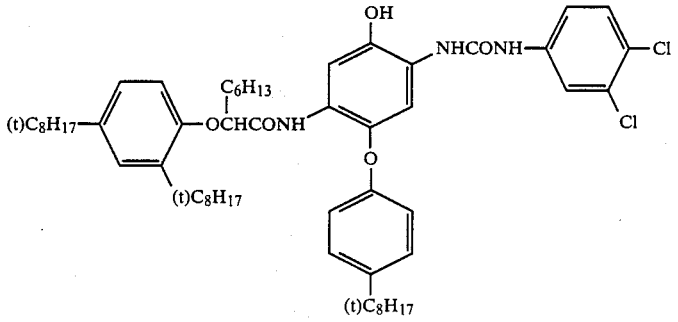

-continued
(C-35)
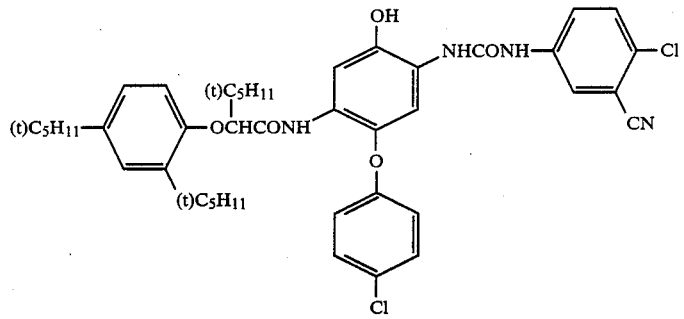
(C-36)
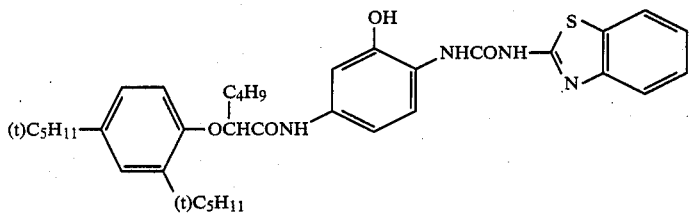
(C-37)
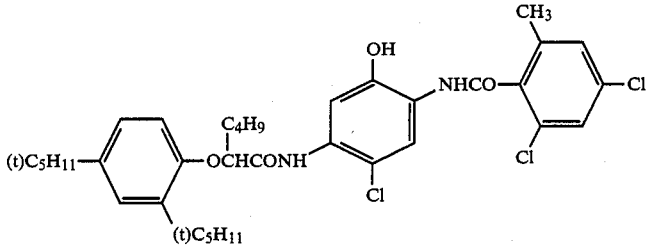
(C-38)
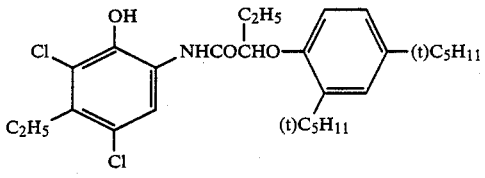
(C-39)
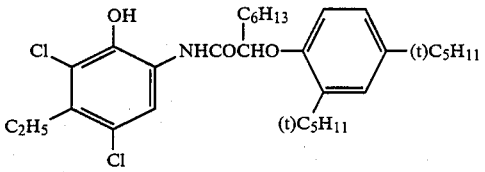
(C-40)
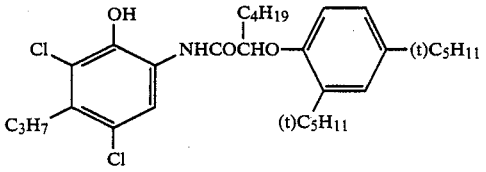
(C-41)
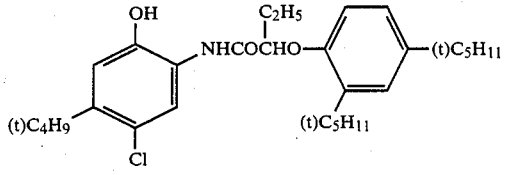

-continued
(C-42)
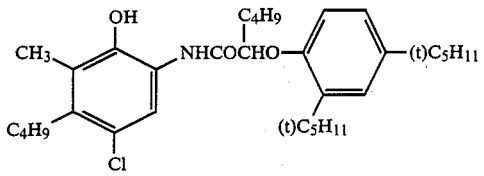
(C-43)
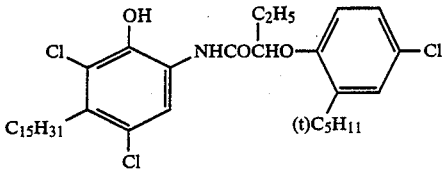
(C-44)
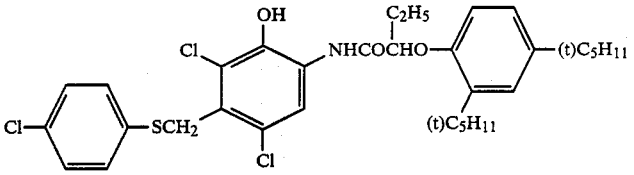
(C-45)
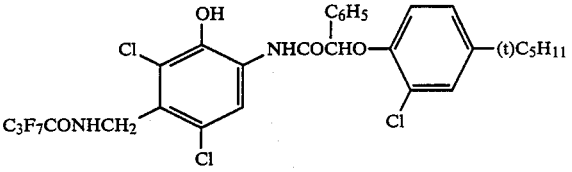
(C-46)
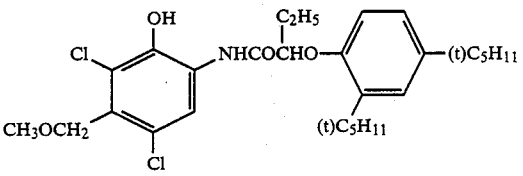
(C-47)
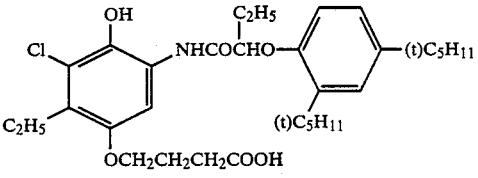
(C-48)
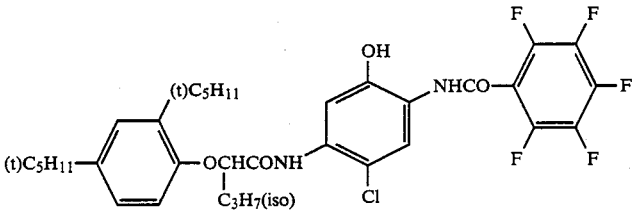
(C-49)
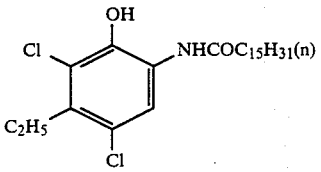

-continued (C-50)

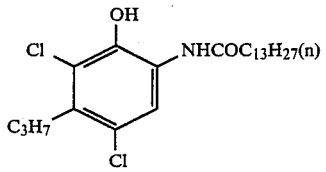

These couplers can be synthesized by known methods as described in Japanese Patent Application (OPI) No. 166956/84 and Japanese Patent Publication No. 11572/74.

The color developing solution used in the present invention will now be explained in detail.

The color developing solution according to the present invention preferably contains no hydroxylamine. If the color developing solution contains hydroxylamine, the content is preferably as little as possible.

Further, the color developing solution contains substantially no benzyl alcohol for the purpose of preventing the formation of fog. The term "color developing solution having substantially no benzyl alcohol content" as used herein means a color developing solution containing benzyl alcohol in an amount of not more than about 2 ml per liter of the solution and preferably a color developing solution which contains no added benzyl alcohol.

Furthermore, the color developing solution according to the present invention preferably contains substantially no p-aminophenol developing agents in view of the effect of the present invention, particularly stability of the developing solution. The term "color developing solution containing substantially no p-aminophenol developing agents" as used herein means a color developing solution containing p-aminophenol developing agents in an amount of not more than about 1 g per liter of the solution and preferably not more than about 0.1 g per liter of the solution.

In addition, the color developing solution preferably contains no couplers such as color couplers.

Further, the color developing solution may contain sulfites such as sodium sulfite, potassium sulfite, sodium bisulfite, potassium bisulfite, sodium metasulfite, potassium metasulfite, etc., or carbonyl-sulfite adducts as preservatives, if desired. The amount of these compounds to be incorporated into the color developing solution is usually from 0 g to about 1.0 g, and preferably from 0 g to about 0.5 g, per liter of the color developing solution, and the amount is preferably as small as possible. When the preservative of the present invention is used in a color developing solution having no benzyl alcohol, the amount of the sulfite ion to be added to the developing solution is preferably as small as possible in view of the preservability and/or the photographic characteristic of the developing solution.

Examples of other usable preservatives include hydroxyacetones as described in U.S. Pat. No. 3,615,503 and British Pat. No. 1,306,176; α-aminocarbonyl compounds as described in Japanese Patent Application (OPI) Nos. 143020/77 and 89425/78; various metals as described in Japanese Patent Application (OPI) Nos. 44148/82 and 53749/82; various saccharides as described in Japanese Patent Application (OPI) No. 102727/77; hydroxamic acids as described in Japanese Patent Application (OPI) No. 27638/77; α,α'-dicarbonyl compounds as described in Japanese Patent Application (OPI) No. 160141/84; salicylic acids as described in Japanese Patent Application (OPI) No. 180588/84; alkanolamines as described in Japanese Patent Application (OPI) No. 3532/79; poly(alkyleneimines) as described in Japanese Patent Application (OPI) No. 94349/81; gluconic acid derivatives as described in Japanese Patent Application (OPI) No. 75647/81; and the like.

Two or more of such preservatives may be employed together, if desired.

Also, it is preferred to add alkanolamines (e.g., triethanolamine, diethanolamine, etc.) and/or aromatic polyhydroxy compounds to the color developing solution.

The color developing solution used in the present invention has a pH which ranges preferably from about 9 to 12, and more preferably from about 9 to 11.0. The color developing solution may also contain any other conventional compounds that are commonly used as components of developing solutions.

In order to maintain the pH in the above described range, various buffers can be preferably employed, including carbonates, phosphates, borates, tetraborates, hydroxybenzoates, glycine salts, N,N-dimethylglycine salts, leucine salts, norleucine salts, guanine salts, 3,4-dihydroxylphenylalanine salts, alanine salts, amino butyrates, 2-amino-2-methyl-1,3-propanediol salts, valine salts, proline salts, trishydroxyaminomethane salts, lysine salts, etc. Particularly, carbonates, phosphates, tetraborates and hydroxybenzoates are preferably employed since they have good solubility and excellent buffering capability in a high pH range such as 9.0 or more, they do not adversely affect on photographic characteristics (such as fog formation) when are added to the color developing solution and they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. The present invention, however, is not limited to these compounds The amount of buffers to be added to the color developing solution is preferably about 0.1 mol or more, and more preferably from about 0.1 to 0.4 mol, per liter of the color developing solution.

In addition, various conventional chelating agents can be used in the color developing solution according to the present invention for the purpose of preventing calcium or magnesium precipitation, or increasing the stability of the color developing solution.

As chelating agents, organic acid compounds are preferred, which include, for example, aminopolycarboxylic acids as described in Japanese Patent Publication Nos. 30496/73 and 30232/69, etc.; organic phosphonic acids as described in Japanese Patent Application (OPI) No. 97347/81, Japanese Patent Publication No. 39359/81, and West German Pat. No. 2,227,639; phosphonocarboxylic acids as described in Japanese Patent Application (OPI) Nos. 102726/77, 42730/78, 121127/79, 126241/80 and 65956/80; and compounds as described in Japanese Patent Application (OPI) Nos. 195845/83 and 203440/83, and Japanese Patent Publication No. 40900/78.

Specific examples of the chelating agents used are set forth below, but the present invention is not to be construed as being limited thereto.

Nitrilotriacetic acid
Diethylenetriaminepentaacetic acid
Ethylenediaminetetraacetic acid
Triethylenetetraminehexaacetic acid
N,N,N-trimethylenephosphonic acid
Ethylenediamine-N,N,N',N'-tetramethylenephosphonic acid
1,3-Diamino-2-propanoltetraacetic acid
trans-Cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more of such chelating agents may be employed together, if desired. The chelating agent can be added to the color developing solution in an amount sufficient to mask metal ions present therein. For example, a range from about 0.1 g to about 10 g per liter of the color developing solution is generally employed.

The color developing solution may contain appropriate development accelerators, if desired, including, e.g., thioether type compounds as described in Japanese Patent Publication Nos. 16088/62, 5987/62, 7826/63, 12380/69 and 9019/70, and U.S. Pat. No. 3,813,247; p-phenylenediamine type compounds as described in Japanese Patent Application (OPI) Nos. 49829/77 and 15554/75; quaternary ammonium salts as described in Japanese Patent Application (OPI) Nos. 137726/75, 156826/81 and 43429/77, and Japanese Patent Publication No. 30074/69; p-aminophenols as described in U.S. Pat. Nos. 2,610,122 and 4,119,462; amine type compounds as described in U.S. Pat. Nos. 2,494,903, 3,128,182, 4,230,796, 3,253,919, 2,482,546, 2,596,926 and 3,582,346, and Japanese Patent Publication No. 11431/66; polyalkylene oxides as described in Japanese Patent Publication Nos. 16088/62, 25201/67, 11431/66 and 23883/67, and U.S. Pat. Nos. 3,138,183 and 3,532,501; 1-phenyl-3-pyrazolidones; hydrazines, mesoionic type compounds; ionic type compounds; imidazoles; etc.

The color developing solution used in the present invention may contain appropriate antifoggants, if desired. Alkali metal halides such as sodium chloride, potassium bromide and potassium iodide, etc. as well as organic antifoggants may be employed as antifoggants Useful representative examples of organic antifoggants include nitrogen-containing heterocyclic compounds such as benzotriazole, 6-nitrobenzimidazole, 5-nitroiosindazole, 5-methylbenzotriazole, 5-nitrobenzotriazole, 5-chlorobenzotriazole, 2-thiazolylbenzimidazole, 2-thiazolylmethylbenzimidazole, an indazole, hydroxyazaindolizine, adenine, etc.

It is preferred that the color developing solutions according to the present invention contain fluorescent brightening agents. As fluorescent brightening agents, 4,4'-diamino-2,2'-disulfostilbene type compounds are preferred. The amount of fluorescent brightening agents to be added is preferably from about 0 to 5 g per liter, and more preferably from about 0.1 g to 4 g, per liter of the color developing solution.

Furthermore, the color developing solution according to the present invention may contain various surface active agents such as alkylphosphonic acids, arylphosphonic acids, aliphatic carboxylic acids, aromatic carboxylic acids, etc., if desired.

The processing temperature of the color developing solution used in the present invention is preferably from about 20° C. to 50° C., and more preferably from about 30° C. to 40° C. The processing time is preferably from about 20 seconds to 5 minutes, and more preferably from about 30 seconds to 2 minutes. Further, a suitable amount of replenisher for the color developing solution is usually from about 20 ml to 600 ml, preferably from about 50 ml to 300 ml and more preferably from about 100 ml to 200 ml, per square meter of the color photographic light-sensitive material, the smaller amount being preferred.

A bleaching solution, a bleach-fixing solution and a fixing solution which can be employed in the processing method according to the present invention are now described in greater detail.

Any conventional bleaching agents can be employed as bleaching agents in a bleaching solution or a bleach-fixing solution used in the present invention. Particularly, organic complex salts of iron (III), for example, complex salts of aminopolycarboxylic acids (e.g., ethylenediaminetetraacetic acid, diethylenetriaminepentaacetic acid, etc.), aminopolyphosphonic acids, phosphonocarboxylic acids and organic phosphonic acids, etc. or complex salts of organic acids (e.g., citric acid, tartaric acid, malic acid, etc.); persulfates; hydrogen peroxide; etc. are preferably used. Of these compounds, organic complex salts of iron (III) are particularly preferred for rapid processing and prevention of environmental pollution.

Specific examples of useful aminopolycarboxylic acids, aminopolyphosphonic acids, organic phosphonic acids or salts thereof suitable for forming organic complex salts of iron (III) are set forth below, although the present invention is not limited thereto.

Ethylenediaminetetraacetic acid
Diethylenetriaminepentaacetic acid
Ethylenediamine-N-(β-oxyethyl)-N,N',N'-triacetic acid
1,3-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
Iminodiacetic acid
Hydroxyliminodiacetic acid
Dihydroxyethylglycine ethyl ether diaminetetraacetic acid
Glycol ether diaminetetraacetic acid
Ethylenediaminetetrapropionic acid
Ethylenediaminedipropionic acid Phenylenediaminetetraacetic acid
2-Phosphonobutane-1,2,4-triacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid
1-Hydroxyethylidene-1,1'-diphosphonic acid These compounds may be in the form of salts such as sodium, potassium, lithium or ammonium.

Of these compounds, iron (III) complex salt of ethylenediaminetetraacetic acid, diethylenetriaminepentaacetic acid, cyclohexanediaminetetraacetic acid, 1,3-diaminopropanetetraacetic acid and methyliminodiacetic acid are preferred because of their high bleaching power.

The ferric ion complex salts may be added in the form of a complex salt per se or may be formed in situ in solution by using a ferric salt (e.g., ferric sulfate, ferric chloride, ferric nitrate, ferric ammonium sulfate or ferric phosphate, etc.) and a chelating agent (e.g., an aminopolycarboxylic acid, aminopolyphosphonic acid or phosphonocarboxylic acid, etc.). When they are used in the form of a complex salt, they may be used alone or as a combination of two or more thereof. Where a complex is formed in situ in solution by using a ferric salt and a chelating agent, one, two or more ferric salts may be used, and one, two or more chelating agents may also be used. In each case, the chelating agent may be used in an excess amount of being necessary for forming a ferric ion complex salt.

Of the ferric ion complexes, ferric complexes of aminopolycarboxylic acids are preferred. The amount of the ferric ion complex in the bleaching solution or bleach-fixing solution is from about 0.01 mol to 1.0 mol, and preferably from about 0.05 mol to 0.50 mol, per liter of the solution.

In the bleaching solution or the bleach-fixing solution, a bleach accelerating agent can be used, if desired. Specific examples of suitable bleach accelerating agents include compounds having a mercapto group or a disulfide group as described in U.S. Pat. Nos. 3,893,858, West German Pat. Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, *Research Disclosure,* No. 17129 (July, 1978), etc.; thiazolidine derivatives as described in Japanese Patent Application (OPI) No. 14029/75, etc.; thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Pat. No. 1,127,715, Japanese Patent Application (OPI) No. 16235/83, etc.; polyethyleneoxides as described in West German Pat. Nos. 966,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79, 26506/80 and 163940/83; iodine ions; and bromine ions, etc. Of these compounds, the compounds having a mercapto group or a disulfide group are preferred in view of their large bleach accelerating effects. Particularly, the compounds as described in U.S. Pat. No. 3,893,858, West German Pat. No. 1,290,812 and Japanese Patent Application (OPI) No. 95630/78 are preferred.

The bleaching solution or bleach-fixing solution used in the present invention can contain rehalogenating agents such as bromides (e.g., potassium bromide, sodium bromide, ammonium bromide, etc.), chlorides (e.g., potassium chloride, sodium chloride, ammonium chloride, etc.) or iodides (e.g., ammonium iodide, etc.). Further, one or more inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), corrosion preventing agents (e.g., ammonium nitrate, guanidine, etc.), or the like may be added, if desired.

The fixing agents which can be employed in the bleach-fixing solution or fixing solution, include any known fixing agents, e.g., water-soluble silver halide solvents such as thiosulfates (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8 -octanediol, etc.); and thioureas may be used individually or in a combination of two or more thereof. In addition, a special bleach-fixing solution comprising a combination of a fixing agent and a large amount of a halide compound such as potassium iodide as described in Japanese Patent Application (OPI) No. 155354/80 can be used. In the present invention, a thiosulfate, and particularly ammonium thiosulfate, is preferably employed.

The amount of fixing agent used in the bleach-fixing solution or fixing solution is preferably from about 0.3 mol to 2 mol, and more preferably from about 0.5 ml to 1.0 mol, per liter of the solution.

The pH of the bleach-fixing solution or fixing solution used in the present invention is preferably from about 3 to 10, and more preferably from about 5 to 9. When the pH of the bleach-fixing solution or fixing solution is lower than this value, desilvering property is increased but degradation of the solution tends to occur and the formation of leuco dyes of cyan dyes is accelerated. On the contrary, when the pH is higher than this value, slowed desilvering and an increase in staining are likely to occur.

In order to adjust the pH, the bleach-fixing solution or fixing solution may contain, if desired, hydrochloric acid, sulfuric acid, nitric acid, acetic acid, a bicarbonate, ammonia, potassium hydroxide, sodium hydroxide, sodium carbonate, potassium carbonate, etc. Further, various kinds of fluorescent brightening agents, defoaming agents and surface active agents, polyvinyl pyrrolidone, organic solvents (e.g., methanol, etc.), etc. may be incorporated into the bleach-fixing solution or fixing solution.

The bleach-fixing solution or fixing solution used in the present invention can contain, as preservatives, compounds capable of releasing sulfite ions such as sulfites (e.g., sodium sulfite, potassium sulfite, ammonium sulfite,etc.), bisulfite (e.g., ammonium bisulfite, sodium bisulfite, etc.), metabisulfites (e.g., potassium metabisulfite, sodium metabisulfite, ammonium metabisulfite, etc.), etc. The amount of such a compound added is preferably from about 0.02 mol to about 0.50 mol, and more preferably from about 0.04 mol to 0.40 mol, per liter of the solution calculated in terms of sulfite ion.

While it is typical to add sulfites as preservatives, other compounds such as ascorbic acid, a carbonylbisulfic acid adduct, a carbonyl compound, etc. may be added, if desired.

Further, buffers, antimolds, etc. may be added, if desired.

A water washing step which can be utilized in the present invention is described below.

According to the present invention, a simplified processing method, for example, a method in which only a stabilizing process is conducted, without carrying out a separate water washing step, can be employed in place of a conventional water washing process. The term water washing step as used herein broadly describes both conventional and simplified processes.

It is difficult to specify the amount of washing water used in the present invention, since it can be varied depending on the number of baths employed in a multistage countercurrent water washing process and the amount of the preceding bath components being carried over with the photographic light-sensitive material. However, it is generally sufficient for the present invention that the amount of the bleaching solution components and fixing solution components is not more than about $1\times10^{-4}$ mol per liter in the final water washing bath. For example, in the case of a countercurrent water washing process using three tanks, the amount of water to be used is preferably about 1,000 ml or more, and more preferably about 5,000 ml or more, per square meter of the photographic light-sensitive material. Further, it is preferred to use from about 100 ml to 1,000 ml of water per square meter of the photographic light-sensitive material in a water-saving process.

The temperature of the water washing step is in a range from about 15° C. to 45° C., and preferably from about 20° C. to 35° C.

In the water washing step used in the present invention, various known compounds may be employed for the purpose of preventing the formation of precipitation or stabilizing the washing water. Examples of such additives include a chelating agent such as an inorganic phosphonic acid, an aminopolycarboxylic acid, an organic phosphonic acid, etc.; a germicide or a fungicide for preventing the propagation of various bacteria, fungi and algae (for example, the compounds as described in *J. Antibact. Antifung, Agents,* Vol. 11, No. 5, pages 207 to 223 (1983) or the compounds as described in Hiroshi Horiguchi, *Antibacterial and Antifungal Chemistry;* a metal salt including a magnesium salt or an aluminium salt, etc.; an alkali metal or ammonium salt; or a surface active agent for reducing drying load or preventing drying marks; or the like. Further, the compounds described in L. E. West, *Phot. Sci. Eng.,* Vol. 6, pages 344 to 359 (1965) may be added thereto.

Further, the present invention is particularly effective when the water washing step is carried out by a multistage countercurrent water washing process using two or more tanks with washing water to which a chelating agent, a germicide or a fungicide is added for the purpose of remarkably reducing the amount of washing water. Moreover, the present invention is also particularly effective in the case wherein a multi-stage countercurrent stabilizing step ("stabilizing process") as described in Japanese Patent Application (OPI) No. 8543/82 is used in place of a conventional water washing step. In these cases, the amount of the bleaching and fixing components in the final bath is not more than about $5\times10^{-2}$ mol/liter, preferably not more than about $1\times10^{-2}$ mol/liter.

To the stabilizing bath used, various compounds may be added for the purpose of stabilizing the images formed. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc. being used alone or in combination) in order to adjust the pH of layers of the photosensitive material (for example, to a pH of about 3 to 8]; and aldehydes such as formalin, etc. In addition, various additives, for example, a chelating agent (e.g., an inorganic phosphonic acid, an aminopolycarboxylic acid, an organic phosphonic acid, an aminopolyphosphonic acid, a phosphonocarboxylic acid, etc.), a germicide (e.g., those of thiazole type, isothiazole type, halogenated phenol type, sulfanilamide type, benzotriazole type, etc.), a surface active agent, a fluorescent brightening agent, a hardening agent, etc. may be employed. Two or more compounds for the same purpose or different purposes may be employed in combination.

Further, it is preferred to add various ammonium salts such as ammonium chloride, ammonium nitrate, ammonium sulfate, ammonium phosphate, ammonium sulfite, ammonium thiosulfate, etc., as pH adjusting agents for layers of the photosensitive materials after development processing, in order to improve image preservability.

When the amount of washing water is greatly reduced as described above, it is preferred that a part or all of overflow from the washing water be introduced into the bleach-fixing bath or fixing bath, which is the preceding bath, for the purpose of reducing the amount of discharge.

Moreover, in the case of continuous processing in the present invention, variation of the composition of each processing solution can be prevented by using a replenisher for each processing solution, whereby consistent results (e.g., constant finish) can be achieved. The amount of replenisher used can be reduced to one half or less of the standard amount of replenishment in order to reduce costs, etc.

In each of the processing baths, any of various conventional processing apparatuses can be used including e.g., a heater, a temperature sensor, a liquid level sensor, a circulation pump, a filter, a floating cover, a squeezer, a nitrogen gas stirrer, an air stirrer, etc.

The method according to the present invention can be applied to any processing method employing a color developing solution. For example, it can be utilized in processing of a color paper, a color reversal paper, color positive films, color negative films, color reversal films, etc. Preferably, the method according to the present invention is utilized in processing of a color paper, or a color reversal paper.

The photographic light-sensitive material used in the present invention is preferably a coupler-in-emulsion type color light-sensitive material in which a color coupler is previously incorporated.

The silver halide emulsion of the photographic light-sensitive material used in the present invention is applied, can contain a silver halide having any known halogen composition, such as silver iodobromide, silver bromide, silver chlorobromide, silver chloride, etc. However, when conducting rapid processing or processing with a low level of replenishment, a silver chlorobromide emulsion containing at least about 60 mol % of silver chloride, and a silver chloride emulsion are preferred, and a silver halide emulsion having a silver chloride content of from about 80 to 100 mol % is particularly preferred.

On the other hand, if high sensitivity is required and it is necessary to control fog formation during the preparation, preservation and/or processing of the photographic light-sensitive material at a particularly low level, a silver chlorobromide emulsion containing at least about 50 mol % of silver bromide and a silver bromide emulsion are preferred; and a silver halide emulsion having a silver bromide content of at least about 70 mol % is more preferred. Although rapid processing becomes difficult when the silver bromide content in the emulsion used exceeds 90 mol %, the development rate can be increased to some extent without the limitation on silver bromide content by using a development accelerator, for example, the combination of a silver halide solvent, a fogging agent, a development accelerating agent such as a developing aid as described hereinafter, present at the time of processing. This method is sometimes preferred.

In any case, the silver iodide content in the emulsion is desirably not more than about 3 mol %. The silver halide emulsions are preferably utilized in a color paper, etc.

Silver halide grains in the silver halide emulsion which can be used in the present invention may have different compositions in the their interior and surface portions, multiphase structures containing junctions, or may be uniform throughout the grains. Further, a mixture of these silver halide grains having different structures may be employed.

The average grain size of silver halide grains used in the present invention (the grain size being defined as grain diameter if the grain has a spherical or a nearly spherical form, and as the length of the edge if the grain has a cubic form, and being averaged based on the projected areas of the grains) is preferably from about 0.1 μm to 2 μm, and particularly from about 0.15 μm to 1.5 μm.

The grain size distribution may be either narrow or broad. It is preferred to employ a monodisperse silver halide emulsion in which the coefficient of variation (obtained by dividing the standard deviation derived from a grain size distribution curve of a silver halide emulsion by the average grain size) is about 20% or less and particularly about 15% or less, in the present invention.

Further, in order to achieve the desired gradation of the light-sensitive material, two or more monodisperse silver halide emulsions which have substantially the same spectral sensitivity but have different grain sizes can be mixed in one emulsion layer or can be coated in the form of superimposed layers. Emulsions having the coefficient of variation described above are preferred. Moreover, two or more polydisperse silver halide emulsions or combinations of a monodisperse emulsion and a polydisperse emulsion may be employed in a mixture thereof or in the form of superimposed layers.

Silver halide grains which can be used in the present invention may have a regular crystal structure, for example, a cubic, octahedral, rhombic dodecahedral or tetradecahedral structure, etc.; an irregular crystal structure, for example, a spherical structure, etc.; or a composite structure thereof. Further, tabular silver halide grains can be used. Particularly, a silver halide emulsion containing tabular silver halide grains having a ratio of diameter/thickness of not less than about 5, preferably not less than about 8 occupying at least about 50% of the total projected area of the silver halide grains present can be employed. In addition, mixtures of silver halide grains having different crystal structures may be used. The silver halide emulsions may be either surface latent image type emulsions in which latent images are formed mainly on the surface of grains, or internal latent image type emulsions in which latent images are formed mainly in the interior of the grains.

The photographic emulsions in materials processed by the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964), etc. That is, any of an acid process, a neutral process, an ammonia process, etc., can be employed.

Soluble silver salts and soluble halogen salts can be reacted by conventional techniques such as a single jet method, a double jet method, and a combination thereof. In addition, a reversal mixing method in which silver halide grains are formed in the presence of an excess of silver ions can be used. As one double jet method, a controlled double jet method, in which the pAg in the liquid phase where silver halide is formed is maintained at a predetermined level, can be employed to prepare a silver halide emulsion in which the crystal form is regular and the particle size is nearly uniform.

Further, a silver halide emulsion which is prepared by a conversion method may be used, in which silver halide previously formed is converted to silver halide having a lower solubility product before the completion of formation of silver halide grains, or a silver halide emulsion which is subjected to similar halogen conversion after the completion of formation of silver halide grains may also be employed.

During the step of formation or physical ripening of silver halide grains, any of cadmium salts, zinc salts, lead salts, copper salts, thallium salts, iridium salts or complex salts thereof, rhodium salts or complex salts thereof, iron salts or complex salts thereof, etc. may be present.

After the formation of silver halide grains, silver halide emulsions are usually subjected to physical ripening, removal of soluble salts and chemical ripening and then used for coating.

Known silver halide solvents (for example, ammonia, potassium thiocyanate, and thioethers and thione compounds as described in U.S. Pat. No. 3,271,157, Japanese Patent Application (OPI) Nos. 12360/76, 82408/78, 144319/78, 100717/79 and 155828/79, etc.) can be present during the step of formation, physical ripening or chemical ripening of silver halide.

For removal of soluble silver salts from the emulsion after physical ripening, a noodle washing process, a flocculation process or an ultrafiltration process, etc. can be employed.

The silver halide emulsion which can be processed according to the present invention is typically sensitized using, e.g., a sulfur sensitization method using active gelatin or compounds containing sulfur capable of reacting with silver (for example, thiosulfates, thioureas, mercapto compounds and rhodanines, etc.); a reduction sensitization method using reducing substances (for example, stannous salts, amines, hydrazine derivatives, formamidinesulfinic acid and silane compounds, etc.); a noble metal sensitization method using metal compounds (for example, complex salts of Group VIII metals in the Periodic Table, such as Pt, Ir, Pd, Rh, Fe, etc., as well as gold complex salts); and so forth, alone or in combination with each other.

Each of blue-sensitive, green-sensitive and red-sensitive emulsions used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes can be present in these dyes as basic heterocyclic nuclei, including, e.g., a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; and further, nuclei formed by condensing aliphatic hydrocarbon rings with these nuclei and nuclei formed by condensing aromatic hydrocarbon rings with these nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. The carbon atoms of these nuclei can also be substituted.

The merocyanine dyes and the complex merocyanine dyes that can be employed contain 5- or 6-membered heterocyclic nuclei such as a pyrazolin-5-one nucleus a thiohydantoin nucleus, a 2-thioxazolidin-2,4dione nucleus, a thiazolidone-2,4-dione nucleus, a rhodanine nucleus, a thiobarbituric acid nucleus, and the like, as nuclei having a keto-methylene structure.

These sensitizing dyes can be used alone and can also be employed in combination. A combination of sensitizing dyes is often used, particularly for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12365/78, Japanese Patent Application (OPI) Nos. 110618/77 and 109925/77, etc.

The sensitizing dyes may be present in the emulsion together with dyes which themselves do not have a spectrally sensitizing effect but that exhibit a supersensitizing effect, or materials which do not substantially absorb visible light but exhibit a supersensitizing effect.

The sensitizing dyes can be added to the silver halide emulsion at any stage of production of the photographic light-sensitive material, that is, during the formation of grains, before, during or after chemical sensitization or during coating. Addition during the formation of grains is effective not only for increased adsorption but also for control of the crystal form and internal structure of the grains. Further, addition during chemical sensitization is effective not only for increased adsorption but also for control of the chemical sensitization site and preventing modification of the crystals. These addition methods are particularly effective for emulsions containing silver chloride in a high ratio, as well as grains having an increased silver bromide content or silver iodide content on the surface thereof.

It is preferable that photographic light-sensitive materials processed according to the invention contain couplers that are rendered diffusion resistant by means of a ballast group or polymerization. It is also preferred that the coupling active positions of couplers be substituted with a group capable of being released (two-equivalent couplers), rather than with a hydrogen atom (four-equivalent couplers), to reduce the coating amount of silver required. Further, couplers which form dyes having an appropriate diffusibility, noncolor forming couplers, or couplers capable of releasing development inhibitors (DIR couplers) or development accelerators by a coupling reaction can be employed.

Typical yellow couplers used in materials processed according to the present invention include oil protected acylacetamide type couplers, such as those described in U.S. Pat. Nos. 2,407,210, 2,875,057 and 3,265,506, etc. In the present invention, two-equivalent yellow couplers are preferably employed, including yellow oxygen atom releasing couplers as described in U.S. Pat. Nos. 3,408,194, 3,447,928, 3,933,501 and 4,022,620, etc. and yellow nitrogen atom releasing couplers as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by good fastness, and particularly good light fastness, of the dyes formed, and α-benzylacetanilide type couplers are characterized by a high color density in the dye image formed.

Magenta couplers used in materials processed according to the present invention include oil protected indazolone type couplers, cyanoacetyl type couplers, and preferably 5-pyrazolone type couplers and pyrazoloazole type couplers such as pyrazolotriazoles. Of 5-pyrazolone type couplers, those substituted with an arylamine group or an acylamino group at the 3-position thereof are preferred in View of the hue and color density of dyes formed. Typical examples thereof are described in U.S. Pat. Nos. 2,311,082, 2,343,703, 2,600,788, 2,908,573, 3,062,653, 3,152,896 and 3,936,015, etc. In two-equivalent 5-pyrazolone type couplers, the nitrogen atom releasing groups as described in U.S. Pat. No. 4,310,619 and the arylthio groups as described in U.S. Pat. No. 4,351,897 are preferred releasing groups. Further, 5-pyrazolone type couplers having a ballast group as described in European Pat. No. 73,636 are advantageous because they provide a high color density.

Examples of pyrazoloazole type couplers include pyrazolobenzimidazoles as described in U.S. Pat. No. 3,369,879, and preferably pyrazolo[5,1-C][1,2,4]triazoles as described in U.S. Pat. No. 3,725,067, pyrazolotetrazoles as described in *Research Disclosure* No. 24230 (June, 1984) and pyrazolopyrazoles as described in *Research Disclosure,* No. 24230 (June, 1984). Imidazo[1,2-b]pyrazoles as described in European Pat. No. 119,741 are preferred and pyrazolo[1,5-b][1,2,4]triazoles as described in European Pat. No. 119,860 are particularly preferred for reducing yellow subsidiary adsorption and improving the light fastness of the dyes formed.

Cyan couplers used in materials processed according to the present invention include oil protected naphthol type and phenol type couplers. Typical examples thereof include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers fast to humidity and temperature are preferably used in the present invention. Typical examples thereof include phenol type cyan couplers having an alkyl group containing more than one carbon atom at the meta-position of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,173, West German Patent Application (DT-OS) No. 3,329,729, and Japanese Patent Application (OPI) No. 166956/84, etc.; and phenol type couplers having a phenylureido group at the 2-position thereof and an acylamino group at the 5-position thereof as described in U.S. Pat. Nos. 3,446,622, 4,333,999, 4,451,559 and 4,427,767, etc.

In the processing method of the present invention, the use of at least one cyan coupler as represented by formulae (C-I) and (C-II) gives excellent photographic characteristics with less fog, which is one characteristic feature of the present invention.

Further, couplers capable of forming dyes of controlled diffusibility can be used together in order to improve graininess. Specific examples of such diffusible dye magenta couplers are described in U.S. Pat. No. 4,366,237 and British Pat. No. 2,125,570, etc. and such yellow, magenta and cyan couplers are described in European Pat. No. 96,570 and West German Patent Application (OLS) No. 3,234,533, etc.

These dye forming couplers and special couplers described above may be used in the form of polymers including dimers or higher polymers. Typical examples of dye forming polymer couplers are described in U.S. Pat. Nos. 3,451,820 and 4,080,211, etc. Specific examples of magenta polymer couplers are described in British Pat. No. 2,102,173 and U.S. Pat. No. 4,367,282, etc.

Two or more couplers which can be used in materials processed according to the present invention can be incorporated together in the same layer for the purpose of providing the properties required of the color photographic light-sensitive material, or the same compound can also be incorporated in two more different layers.

The couplers suitably can be incorporated into the photographic light-sensitive material using an oil drop in water dispersion method. By means of the oil droplet in water dispersion method, couplers are dissolved in either an organic solvent having a high boiling point of about 175° C. or more, an auxiliary solvent having a low boiling point, or a mixture thereof, and then the solution is finely dispersed in an aqueous medium such as water or an aqueous gelatin solution, etc., in the presence of a surface active agent. Specific examples of the organic solvents having a high boiling point are described in U.S. Pat. No. 2,322,027, etc. In order to prepare a dispersion, phase inversion may be accompanied. Further, such dispersions are utilized for coating after removing or reducing the auxiliary solvent therein by distillation, noodle washing or ultra-filtration, etc., if desired.

Specific examples of the organic solvent having a high boiling point include phthalic acid esters (for example, dibutyl phthalate, dicyclohexyl phthalate, di-2ethylhexyl phthalate, didodecyl phthalate, etc.), phosphoric or phosphonic acid esters (for example, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphonate, etc.), benzoic acid esters (for example, 2-ethylhexyl benzoate, dodecyl benzoate, 2-ethylhexyl-p-hydroxybenzoate, etc.), amides (for example, diethyldodecanamide, N-tetradecylpyrrolidone, etc.), alcohols or phenols (for example, isostearyl alcohol, 2,4-di-tertamylphenol, etc.), aliphatic carboxylic acid esters (for example, dioctyl azelate, glycerol tributyrate, isostearyl lactate, trioctyl citrate, etc.), aniline derivatives (for example, N,N-dibutyl-2-butoxy-5-tert-octylaniline, etc.), hydrocarbons (for example, paraffin, dodecylbenzene, diisopropylnaphthalene, etc.), etc. As the auxiliary solvents, organic solvents having a boiling point of about 30° C. or more, preferably from about 50° C. to about 160° C., etc. can be used. Typical examples of such auxiliary solvents include ethyl acetate, butyl acetate, ethyl propionate, methyl ethyl ketone, cyclohexanone, 2-ethoxyethyl acetate, dimethylformamide, etc.

The processess and effects of latex dispersing methods and the specific examples of latexes for impregnation are described in U.S. Pat. No. 4,199,363, West German Patent Application (OLS) Nos. 2,541,274 and 2,541,230, etc.

The color couplers are generally employed in an amount of about 0.001 mol to 1 mol per mol of light-sensitive silver halide contained in the layer to which they are added. It is preferred that the amount of yellow coupler, magenta coupler and cyan coupler used be in a range of about 0.01 mol to 0.5 mol, about 0.003 mol to 0.3 mol and about 0.002 mol to 0.3 mol per mol of light-sensitive silver halide, respectively.

The color photographic light-sensitive material used in the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color stain preventing agents.

In the color photographic light-sensitive material used in the present invention, various known color fading preventing agents can be employed. Typical examples of organic color fading preventing agents include hindered phenols, for example, hydroquinones, 6-hydroxycoumarones, 5-hydroxycoumarans, spirochromans, p-alkoxyphenols, bis-phenols, etc., gallic acid derivatives, methylenedioxybenzenes, aminophenols, hindered amines, or ether or ester derivatives thereof derived from each of these compounds by silylation or alkylation of the phenolic hydroxy group thereof. Further, metal complexes represented by (bis-salicylaldoxymate) nickel complexes and (bis-N,N-dialkyldithiocarbamate) nickel complexes may be employed.

For the purpose of preventing degradation of yellow dye images due to heat, humidity and light, compounds containing both a hindered amine partial structure and a hindered phenol partial structure as described in U.S. Pat. No. 4,268,593 provide good results. For the purpose of preventing degradation of magenta dye images, particularly degradation due to light, spiroindanes as described in Japanese Patent Application (OPI) No. 159644/81 and chromans substituted with a hydroquinone diether or monoether as described in Japanese Patent Application (OPI) No. 89835/80 provide improved results.

In order to improve preservability, and particularly the light fastness of cyan dye images, it is preferred to use a benzotriazole type ultraviolet light absorbing agent in combination with a cyan coupler. Such an ultraviolet light absorbing agent may be emulsified together with a cyan coupler. The coating amount of the ultraviolet light absorbing agent is selected so as to sufficiently improve the light stability of cyan dye images. When the amount of the ultraviolet light absorbing agent employed is too large, yellow coloration may occur in unexposed areas (white background areas) of the color photographic materials. Therefore, the amount is preferably in a range from about $1\times10^{-4}$ mol/m$^2$ to $2'10^{-3}$ mol/m$^2$, particularly from about $5\times10^{-4}$ mol/m$^2$ to $1.5\times10^{-3}$ mol/m$^2$.

In a color printing paper having a conventional light-sensitive layer structure, the ultraviolet light absorbing agent is incorporated into one of two layers adjacent to a red-sensitive emulsion layer containing a cyan coupler, and preferably to both adjacent layers. When the ultraviolet light absorbing agent is incorporated into an interlayer positioned between a green-sensitive emulsion layer and a red-sensitive emulsion layer, it may be emulsified together with a color mixing preventing agent. When the ultraviolet light absorbing agent is added to a protective layer, another protective layer may be separately provided thereon as the outermost layer. In the outermost protective layer, a matting agent having an appropriate grain size, etc. can be incorporated.

The color photographic light-sensitive material used in the present invention may contain an ultraviolet absorbing agent in a hydrophilic colloid layer thereof.

The color photographic light-sensitive material used in the present invention may contain water-soluble dyes as filter dyes, for preventing irradiation or halation, or for other various purposes in a hydrophilic colloid layer thereof, and of these dyes, oxonol dyes, anthraquinone dyes and azo dyes are preferred. Oxonol dyes which absorb green light or red light are particularly preferred.

The color photographic light-sensitive material used in the present invention may contain a brightening agent of the stilbene series, triazine series, oxazole series, or coumarine series, etc., in photographic emulsion layers or other hydrophilic colloid layers. Water-soluble brightening agents can be employed, and water-insoluble brightening agents may be used in the form of a dispersion.

The present invention can be applied to a multilayer multicolor photographic light-sensitive material having at least two differently spectrally sensitized silver halide photographic emulsion layers on a support. Multilayer natural color photographic light-sensitive materials usually have at least one red-sensitive silver halide emulsion layer, at least one blue-sensitive silver halide emulsion layer and at least one green-sensitive emulsion layer on a support. The order of the disposition of these emulsion layers can be suitably selected as desired. Further, each of the above described emulsion layers may be composed of two or more emulsion layers having different sensitivities. Moreover, a light-insensitive layer may be present between two or more emulsion layers sensitive to the same spectral wavelength range.

In the color photographic light-sensitive materials used in the present invention, it is preferred to provide appropriate light-insensitive layers such as a protective layer, an layer, a filter layer, an antihalation layer, a backing layer, etc., in addition to the silver halide emulsion layers.

As the binder or the protective colloid for the photographic emulsion layers or interlayers of the color photographic light-sensitive material used in the present invention, gelatin is advantageously used, but other hydrophilic colloids can also be used.

For example, it is possible to use proteins such as gelatin derivatives, graft polymers of gelatin and other polymers, albumin, casein, etc.; saccharides, for example, cellulose derivatives such as hydroxyethyl cellulose, carboxymethyl cellulose, cellulose sulfate, etc., sodium alginate, starch derivatives, etc.; and various synthetic hydrophilic high molecular substances such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

It is particularly effective to the acrylic acid modified polyvinyl alcohol in a protective layer, particularly when an emulsion having a high silver chloride content is subjected to rapid processing.

Suitable gelatins include not only lime-processed gelatin, but also acid-processed gelatin and enzyme-processed gelatin as described in *Bull. Soc. Sci. Phot. Japan,* No. 16, Page 30 (1966). Further, hydrolyzed gelatin products or enzymatically decomposed gelatin products can also be used.

Moreover, color photographic light-sensitive materials used in the present invention can contain various stabilizers, contamination preventing agents, developing agents or precursors thereof, development accelerating agents or precursors thereof, lubricants, mordants, matting agents, antistatic agents, plasticizers or other conventional additives useful for photographic light-sensitive materials in addition to the above-described additives. Typical examples of these additives are described in *Research Disclosure,* No. 17643 (December, 1978) and ibid., No. 18716 (November, 1979).

These additives are very important in rapid printing and rapid processing, and further in relation to the compound represented by general formula (I). In the present invention, it is particularly effective to use a mercaptoazole compound, a mercaptothiadiazole compound or a mercaptobenzazole compound in a silver halide emulsion having a high silver chloride content from the standpoint of color forming properties and formation of fog.

The term "reflective support" which can be employed in the present invention means a support providing increased reflectiveness for the purpose of making the dye images formed in the silver halide emulsion layer clear. Examples of reflective supports include a support having coated thereon a hydrophobic resin containing a light reflective substance such as titanium oxide, zinc oxide, calcium carbonate, calcium sulfate, etc. dispersed therein, and a support composed of a hydrophobic resin containing a light reflective substance dispersed therein. More specifically, such supports include baryta coated paper, polyethylene coated paper, polypropylene type synthetic paper, a transparent support, for example, a glass plate, a polyester film such as a polyethyleneterephthalate film, a cellulose triacetate film, a cellulose nitrate film, etc., a polyamide film, a polycarbonate film, a polystyrene film, etc. having a reflective layer or having incorporated therein a reflective substance. A suitable support can be appropriately selected depending on the intended use.

The present invention is explained in greater detail with reference to the following examples, but the present invention is not to be construed as being limited thereto. Unless otherwise indicated, all parts, percents and ratios are by weight.

EXAMPLE 1

A multilayer color photographic paper was prepared by forming the layers having the compositions shown in Table 1 below on a paper support both surfaces of which were coated with polyethylene. The coating solutions were prepared in the following manner.

Preparation of Coating Solution for First Layer:

In a mixture of 27.2 ml of ethyl acetate and 7.9 ml of Solvent (c) were dissolved 19.1 g of Yellow Coupler (a) and 4.4 g of Color Image Stabilizer (b) and the solution thus obtained was dispersed by emulsification in 185 ml of a 10 wt % aqueous gelatin solution containing 8 ml of a 10 wt % sodium dodecylbenzenesulfonate solution. Separately, 90 g of a silver chlorobromide emulsion (containing 1 mol % silver bromide and 70 g of silver per kg of the emulsion) containing the blue-sensitive sensitizing dye shown below in an amount of $5.0\times10^{-4}$ mol per mol of silver chlorobromide was prepared as a blue-sensitive emulsion. The emulsified dispersion prepared above was mixed with the aforesaid silver halide emulsion and the gelatin concentration was adjusted as shown in Table 1 below to provide the coating solution for the first layer.

Coating solutions for the second layer to the seventh layer were also prepared in the same manner as described for the coating solution for the first layer, with the substitutions shown below.

As a gelatin hardening agent for each layer, 1-hydroxy-3,5-dichloro-s-triazine sodium salt was used.

The following spectral sensitizers were employed in the respective emulsion layers.

Blue-sensitive Emulsion Layer:

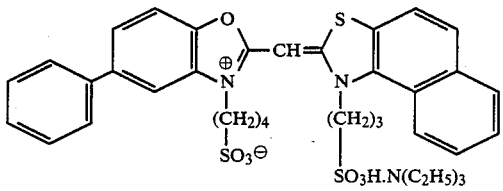

Amount added: $7\times10^{-4}$ mol per mol of silver halide)

Green-sensitive Emulsion Layer:

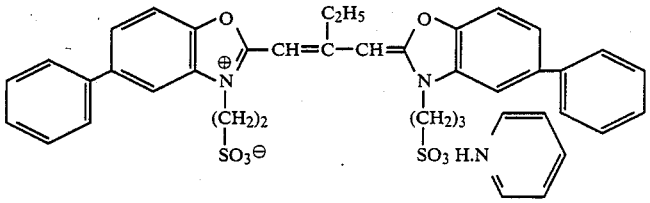

(Amount added: $4\times10^{-4}$ mol per mol of silver halide)

Red-sensitive Emulsion Layer:

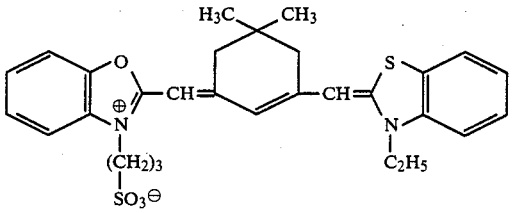

(Amount added: $2\times10^{-4}$ mol per mol of silver halide)

The following dyes were employed as irradiation preventing dyes in the emulsion layers, respectively.

Green-sensitive Emulsion Layer:

-continued

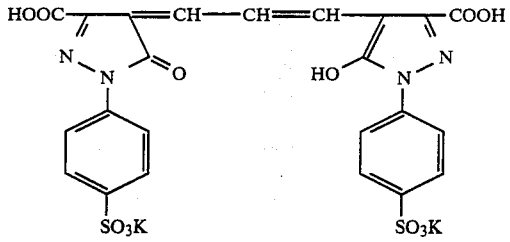

Red-sensitive Emulsion Layer:

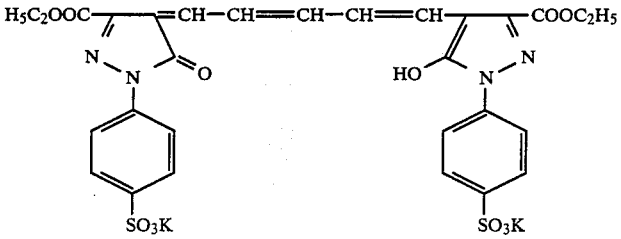

TABLE 1

| Layer | Main Composition | Amount Used |
|---|---|---|
| Seventh Layer (Protective layer) | Gelatin | 1.33 g/m$^2$ |
| | Acryl-modified Polyvinyl Alcohol Copolymer (degree of modification: 17%) | 0.17 g/m$^2$ |
| Sixth Layer (Ultraviolet light absorbing layer) | Gelatin | 0.54 g/m$^2$ |
| | Ultraviolet Light Absorbing Agent (h) | 0.21 g/m$^2$ |
| | Solvent (j) | 0.09 ml/m$^2$ |
| Fifth Layer (Red-sensitive layer) | Silver Chlorobromide Emulsion (silver bromide: 0.5 mol %) | 0.26 g/m$^2$ (as silver) |
| | Gelatin | 0.98 g/m$^2$ |
| | Cyan Coupler (k) | 0.38 g/m$^2$ |
| | Color Image Stabilizer (l) | 0.17 g/m$^2$ |
| | Solvent (m) | 0.23 ml/m$^2$ |
| Fourth Layer (Ultraviolet light absorbing layer) | Gelatin | 1.60 g/m$^2$ |
| | Ultraviolet Light Absorbing Agent (h) | 0.62 g/m$^2$ |
| | Color Stain Preventing Agent (i) | 0.05 g/m$^2$ |
| | Solvent (j) | 0.26 ml/m$^2$ |
| Third Layer (Green-sensitive layer) | Silver Chlorobromide Emulsion (Silver bromide: 0.5 mol %) | 0.16 g/m$^2$ (as silver) |
| | Gelatin | 1.80 g/m$^2$ |
| | Magenta Coupler (e) | 0.48 g/m$^2$ |
| | Color Image Stabilizer (f) | 0.20 g/m$^2$ |
| | Solvent (g) | 0.68 ml/m$^2$ |
| Second Layer (Color stain preventing layer) | Gelatin | 0.99 g/m$^2$ |
| | Color Stain Preventing Agent (d) | 0.08 g/m$^2$ |
| First Layer (Blue-sensitive layer) | Silver Chlorobromide Emulsion (silver bromide: 1.0 mol %) | 0.30 g/m$^2$ (as silver) |
| | Gelatin | 1.86 g/m$^2$ |
| | Yellow Coupler (a) | 0.82 g/m$^2$ |
| | Color Image Stabilizer (b) | 0.19 g/m$^2$ |
| | Solvent (c) | 0.34 ml/m$^2$ |
| Support | Polyethylene laminated paper (coated by the polyethylene coating containing a white pigment ($TiO_2$) and a bluish dye (ultramarine) on the first layer side). | |

The compounds used in the above-described layers have the structures shown below respectively.

Yellow Coupler (a):

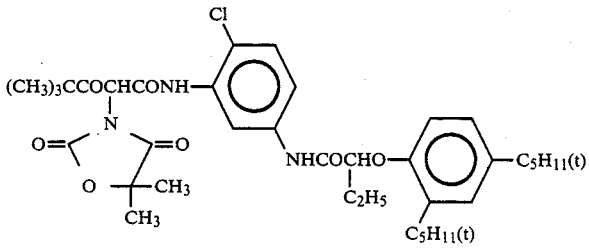

Color Image Stabilizer (b):

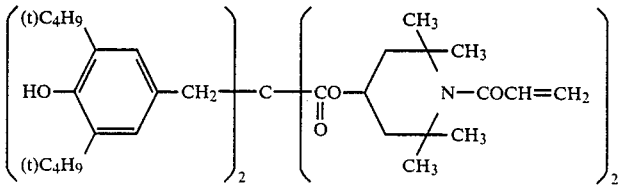

-continued
Solvent (c):
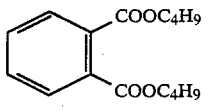
Color Stain Preventing Agent (d):
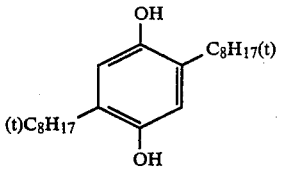
Magenta Coupler (e):
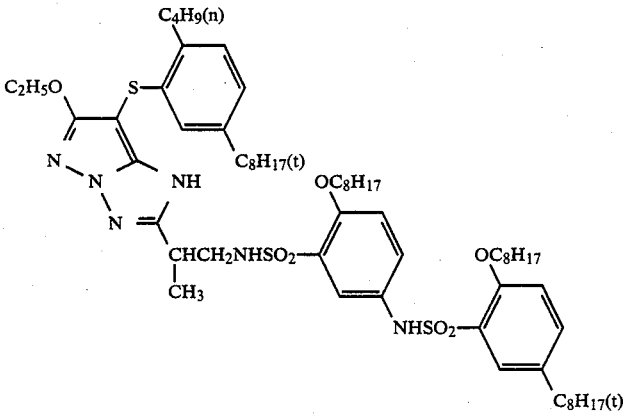
Color Image Stabilizer (f):
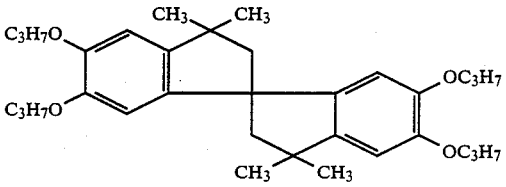
Solvent (g):
2/1 (by weight) mixture of the following compounds
$(C_8H_{17}O)_3-P=O$, and (
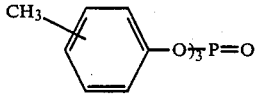
Ultraviolet Light Absorbing Agent (h):
1/5/3 (by mol) mixture of the following compounds
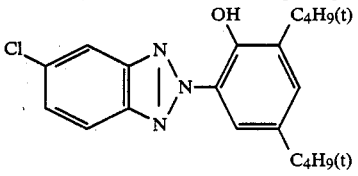
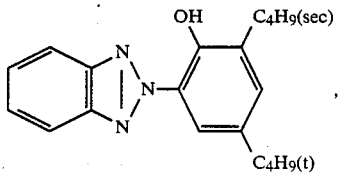
, and -continued
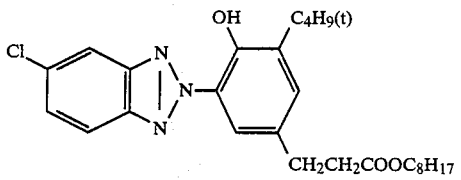
Color Stain Preventing Agent (i):
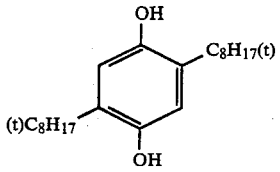
Solvent (j):
- (iso $C_9H_{19}O)_3P{=}O$
Cyan Coupler (k):
1/1 (by mol) mixture of the following compounds
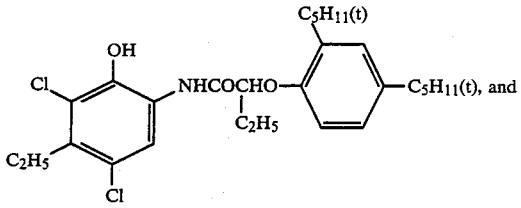
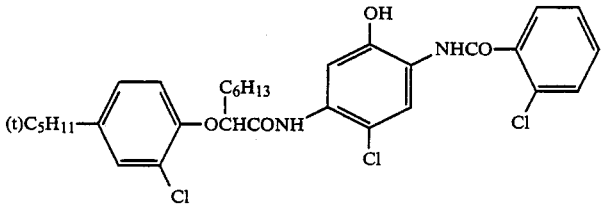
Color Image Stabilizer (l):
1/3/3 (by mol) mixture of the following compounds
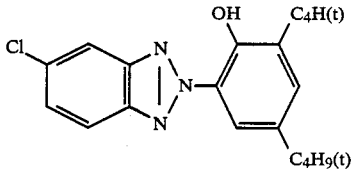
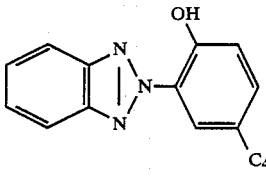
, and
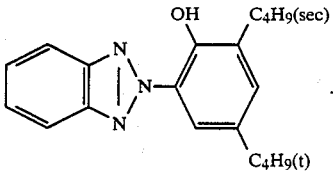
Solvent (m):

-continued

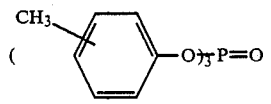

The color photographic paper thus prepared was, subjected to wedge exposure and then development processing according to the following processing steps where the composition of the developing solution for use in the color development was varied.

| Processing Step | Temperature | Time |
|---|---|---|
| Color Development | 35° C. | 45 sec |
| Bleach-fixing | 35° C. | 45 sec |
| Rinsing (1) | 35° C. | 20 sec |
| Rinsing (2) | 35° C. | 20 sec |
| Rinsing (3) | 35° C. | 20 sec |
| Drying | 80° C. | 60 sec |

The rinsing steps were carried out using a three-tank countercurrent process from Rinsing (3) to Rinsing (1). The composition of each processing solution was as follows.

| Color Development Solution | |
|---|---|
| Additive | See Table 2 |
| Benzyl Alcohol | See Table 2 |
| Diethylene Glycol | See Table 2 |
| Sodium Sulfite | 0.2 g |
| Potassium Carbonate | 30 g |
| EDTA/2Na | 1 g |
| Sodium Chloride | 1.5 g |
| Color Developing Agent (See Table 1) | 0.012 mol |
| Fluorescent Brightening Agent (4,4'-Diaminostilbene type) | 3.0 g |
| Water to make | 1000 ml |
| pH | 10.05 |
| Bleach-fixing Solution | |

-continued

| | |
|---|---|
| $EDTAFe(III)NH_4.2H_2O$ | 60 g |
| $EDTA.2Na.2H_2O$ | 4 g |
| Ammonium Thiosulfate (70 wt % aq. soln.) | 120 ml |
| Sodium Sulfite | 16 g |
| Glacial Acetic Acid | 7 g |
| Water to make | 1000 ml |
| pH | 5.5 |
| Rinsing Solution | |
| Formalin (37 wt %) | 0.1 ml |
| 1-Hydroxyethylidene-1,1-diphosphonic Acid (60 wt %) | 1.6 ml |
| Bismuth Chloride | 0.35 g |
| Aqueous Ammonia (26 wt %) | 2.5 ml |
| Trisodium Nitrilotriacetate | 1.0 g |
| EDTA.4H | 0.5 g |
| Sodium Sulfite | 1.0 g |
| 5-Chloro-2-methyl-4-isothiazolin-3-one | 50 mg |
| Water to make | 1000 ml |

Two kinds of the color developing solution having the above-mentioned composition were used, and one was a fresh solution immediately after prepared and the other was an aged solution which was left at 40° C. for 14 days after prepared.

The photographic characteristics obtained by processing with fresh solution and with aged solution are shown in Table 2 below, including using Dmin (minimum density) and gradation of magenta image.

The gradation was defined as the difference in optical density between the exposure producing an optical density of 0.5 and the density produced by an exposure 0.3 log E units higher.

TABLE 2

| Sample No. | Color Developing Agent(*) | Benzyl Alcohol (ml) | Diethylen Glycol (ml) | Additive (0.04 mol/l) | Fresh Solution Dmin | Fresh Solution Gradation | Aged Solution Dmin | Aged Solution Gradation | Remarks |
|---|---|---|---|---|---|---|---|---|---|
| 1 | (d) | — | — | Hydroxylamine | 0.13 | 0.52 | 0.21 | 0.65 | Comparison |
| 2 | (d) | 15 | 10 | " | 0.14 | 0.73 | 0.22 | 0.89 | " |
| 3 | (d) | | | — | 0.15 | 0.72 | 0.30 | 0.51 | " |
| 4 | (a) | — | — | (2) | 0.14 | 0.72 | 0.17 | 0.63 | " |
| 5 | (b) | — | — | (2) | 0.14 | 0.73 | 0.18 | 0.59 | " |
| 6 | (c) | — | — | (2) | 0.14 | 0.72 | 0.16 | 0.60 | " |
| 7 | (d) | — | — | (2) | 0.13 | 0.71 | 0.13 | 0.71 | The Invention |
| 8 | (d) | 5 | 5 | (2) | 0.13 | 0.74 | 0.18 | 0.80 | Comparison |
| 9 | (d) | 15 | 10 | (2) | 0.13 | 0.73 | 0.19 | 0.76 | " |
| 10 | (d) | 15 | 10 | (3) | 0.13 | 0.75 | 0.17 | 0.83 | " |
| 11 | (d) | 15 | 10 | (5) | 0.14 | 0.74 | 0.21 | 0.75 | " |
| 12 | (d) | 15 | 10 | (13) | 0.13 | 0.74 | 0.19 | 0.72 | " |
| 13 | (d) | — | — | (3) | 0.13 | 0.73 | 0.13 | 0.75 | The Invention |
| 14 | (d) | — | — | (5) | 0.13 | 0.73 | 0.13 | 0.73 | " |
| 15 | (d) | — | — | (13) | 0.13 | 0.73 | 0.14 | 0.76 | " |

Note (*):

Color Developing Agent (a): (Comparison)

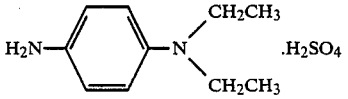

Color Development Agent (b): (Comparison)

TABLE 2-continued

| Sample No. | Color Developing Agent(*) | Benzyl Alcohol (ml) | Diethylen Glycol (ml) | Additive (0.04 mol/l) | Fresh Solution Dmin | Fresh Solution Gradation | Aged Solution Dmin | Aged Solution Gradation | Remarks |
|---|---|---|---|---|---|---|---|---|---|

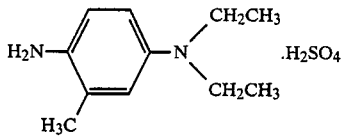

Color Developing Agent (c): (Comparison)

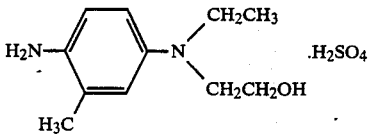

Color Development Agent (d): (The Invention)

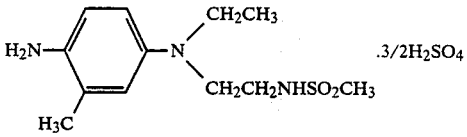

The results in Table 2 prove the following facts: If no preservative was used or hydroxylamine was used as the preservative, the formation of fog was noticeable and the gradation varied with lapse of time (Sample Nos. 1, 2 and 3). If the color developing agent which is outside the present invention was used, the formation of fog was noticeable with the variation of the photographic properties (Sample Nos. 4, 5 and 6).

On the other hand, when the compound of the present invention was used in the absence of benzyl alcohol, the results were good (Sample Nos. 7, 13, 14 and 15). However, the use of the compound of the present invention in the presence of benzyl alcohol resulted in the noticeable formation of fog, which is therefore problematic for practical use (Sample Nos. 8, 9, 10, 11, 12).

EXAMPLE 2

A color photographic paper was prepared in the same manner as described in Example 1 except for using a silver chlorobromide emulsion having a silver bromide content of 80 mol% in place of the emulsion used in the third layer. Using this color photographic paper, the change in photographic properties was determined in the same manner as described in Example 1. As a result, the photographic properties of the samples processed by the solution having the composition of the present invention were good, where the increment of fog by the use of the aged solution was small.

EXAMPLE 3

The same treatment as Example 1 was carried out, except that the above-mentioned Compound (9), (11) or (14) was used in place of Compound (3), (5) or (13) of Sample No. 13, 14 or 15, respectively, and the variation of the photographic characteristics were evaluated for the cases using the lapsed color developer solution in the same manner as Example 1. As a result, the photographic characteristics of the samples processed by the solution having the composition of the present invention were good, where the increment of fog by the use of the lapsed solution was small.

EXAMPLE 4

A first layer (lowermost layer) to a seventh layer (uppermost layer) as shown in Table 3 below were coated on a polyethylene laminate-duplicated paper support which had been treated by corona-discharge, to obtain a multilayer color photographic paper sample.

The coating solution of the first layer was prepared in the following manner, using the components specified below. A mixture comprising 200 g of a yellow coupler, 93.3 g of Color Fading Preventing Agent (r), 10 g of Solvent (p) having a high boiling point, 5 g of Solvent (q) having a high boiling point and 600 ml of ethyl acetate as an auxiliary solvent was dissolved by heating at 60° C. The solution was mixed with 3,300 ml of a 5 wt % gelatin-aqueous solution containing 330 ml of a 5 wt % aqueous solution of Alkanol B (alkylnaphthalenesulfonate, manufactured by du Pont Ltd.) and emulsified using a colloid mill to prepare a coupler dispersion. From the dispersion ethyl acetate was distilled off under a reduced pressure, and then the dispersion was added to 1,400 g of an emulsion (containing 96.7 g of silver and 170 g of gelatin) containing a sensitizing dye for a blue-sensitive emulsion layer and 1-methyl-2-mercapto-5-acetylamino-1,3,4-triazole. Further, 2,600 g of a 10 wt % gelatin-aqueous solution was added thereto to prepare the coating solution.

Coating solutions for the second layer to the seventh layer were prepared in the same manner as described for the cotating solution for the first layer, with the substitutions indicated below.

TABLE 3

| Layer | Composition | |
|---|---|---|
| Seventh Layer (Protective layer) | Gelatin | 600 mg/m$^2$ |
| Sixth Layer (Ultraviolet light absorbing layer) | Ultraviolet light absorbing agent (n) | 260 mg/m$^2$ |
| | Ultraviolet light absorbing agent (o) | 70 mg/m$^2$ |
| | Solvent (p) | 300 mg/m$^2$ |
| | Solvent (q) | 100 mg/m$^2$ |
| | Gelatin | 700 mg/m$^2$ |

TABLE 3-continued

| | | |
|---|---|---|
| Fifth Layer (Red-sensitive layer) | Silver chlorobromide emulsion (bromide content: 1 mol %) | 210 mg/m$^2$ (as silver) |
| | Cyan coupler (See Table 4) | 0.5 mmol/m$^2$ |
| | Color fading preventing agent (r) | 250 mg/m$^2$ |
| | Solvent (p) | 160 mg/m$^2$ |
| | Solvent (q) | 100 mg/m$^2$ |
| | Gelatin | 1,800 mg/m$^2$ |
| Fourth Layer (Color stain preventing layer) | Color stain preventing agent (s) | 65 mg/m$^2$ |
| | Ultraviolet light absorbing agent (n) | 450 mg/$^2$ |
| | Ultraviolet light absorbing agent (o) | 230 mg/m$^2$ |
| | Solvent (p) | 50 mg/m$^2$ |
| | Solvent (q) | 50 mg/m$^2$ |
| | Gelatin | 1,700 mg/m$^2$ |
| Third Layer (Green-sensitive layer) | Silver chlorobromide emulsion (bromide content: 0.5 mol %) | 305 mg/m$^2$ (as silver) |
| | Magenta coupler | 670 mg/m$^2$ |
| | Color fading preventing agent (t) | 150 mg/m$^2$ |
| | Color fading preventing agent (u) | 10 mg/m$^2$ |
| | Solvent (p) | 200 mg/m$^2$ |
| | Solvent (q) | 10 mg/m$^2$ |
| | Gelatin | 1,400 mg/m$^2$ |
| Second Layer (Color stain preventing layer) | Silver bromide emulsion (primitive emulsion, grain size: 0.05 μm) | 10 mg/m$^2$ (as silver) |
| | Color stain preventing agent (s) | 55 mg/m$^2$ |
| | Solvent (p) | 30 mg/m$^2$ |
| | Solvent (q) | 15 mg/m$^2$ |
| | Gelatin | 800 mg/m$^2$ |
| First Layer (Blue-sensitive layer) | Silver chlorobromide emulsion (bromide content: 1 mol %) | 290 mg/m$^2$ (as silver) |
| | Yellow coupler | 600 mg/m$^2$ |
| | Color fading preventing agent (r) | 280 mg/m$^2$ |
| | Solvent (p) | 30 mg/m$^2$ |

TABLE 3-continued

| | | |
|---|---|---|
| | Solvent (q) | 15 mg/m$^2$ |
| | Gelatin | 1,800 mg/m$^2$ |
| Support | Paper support, both surfaces of which were laminated with polyethylene | |

As a spectral sensitizer for the respective emulsion layers, the following dyes were used.

| | |
|---|---|
| Blue-sensitive Emulsion Layer: | Anhydro-5-methoxy-5'-methyl-3,-3'-disulfopropyl-selenacyanine-hydroxide |
| Green-sensitive Emulsion Layer: | Anhydro-9-ehtyl-5,5'-diphenyl-3,3'-disulfoethyloxacarbocyanine-hydroxide |
| Red-sensitive Emulsion Layer: | 3,3'-Diethyl-5-methoxy-9,9'-(2,2-dimethyl-1,3-propano)-thiadicarbocyanine-iodide |

As a stabilizer for the respective emulsion layers, 1-methyl-2-mercapto-5-acetylamino-1,3,4-triazole The following compounds were employed as irradiation preventing dyes in the emulsion layers, respectively.

Dipotassium 4-(3-carboxy-5-hydroxy-4-(3-(3-carboxy-5-oxo-1-(4-sulfonatophenyl)-2-pyrazolin-4-ylidene-1-propenyl)-1-pyrazolyl)benzenesulfonate.

Tetrasodium N,N'-(4,8-dihydroxy-9,10-dioxo-3,7-disulfonatoanthracene-1,5-diyl)-bis(aminomethanesulfonate).

As a hardener, 1,2-bis(vinylsulfonyl)ethane was used.

The couplers as used were as follows.

Yellow Coupler:

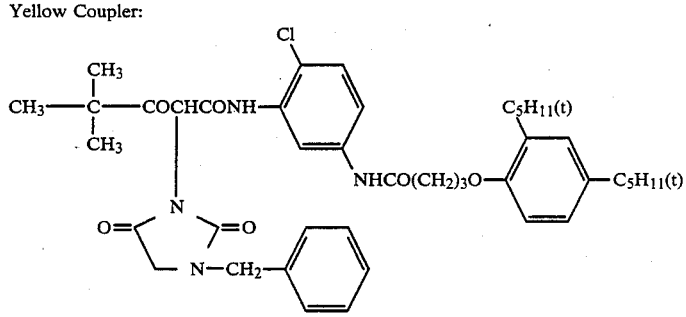

Magenta Coupler:

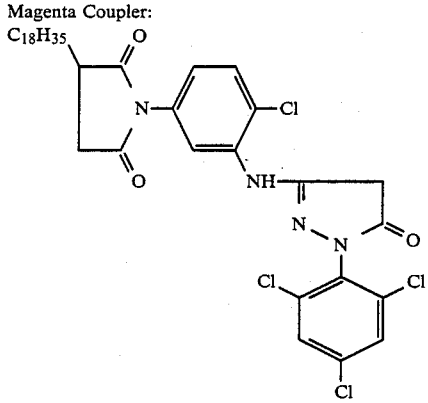

The cyan couplers used are set forth in the following Table 4.

The other compounds used in the above-described layers are as follows:

Ultraviolet Light Absorbing Agent (n):

2-(2-Hydroxy-3,5-di-tert-amylphenyl)benzotriazole

Ultraviolet Light Absorbing Agent (o):

2-(2-hydroxy-3,5-di-tert-butylphenyl)benzotriazole

Solvent (p):
Di(2-ethylhexyl)phthalate
Solvent (q):
Dibutyl phthalate
Color Fading Preventing Agent (r):
2,5-Di-tert-amylphenyl-3,5-di-tert-butyl hydroxybenzoate
Color Stain Preventing Agent (s)
2,5-Di-tert-octylhydroquinone
Color Fading Preventing Agent (t):
1,4-Di-tert-amyl-2,5-dioctyloxybenzene
Color Fading Preventing Agent (u):
2,2'-Methylenebis-(4-methyl-6-tert-butylphenol)

The multilayer color photographic paper thus prepared was subjected to wedge exposure and then development processing according to the following processing steps.

| Processing Steps | Time | Temperature |
|---|---|---|
| Color Development | 3 min 30 sec | 33° C. |
| Bleach-fixing | 1 min 30 sec | 33° C. |
| Rinsing (three tank-cascade) | 2 min | 30° C. |
| Drying | 1 min | 80° C. |

The composition of each processing solution as used herein was as follows:

| Color Developing Solution | |
|---|---|
| Water | 800 ml |
| Triethanolamine | 10 ml |
| Sodium 5,6-Dihydroxy-1,2,4-benzene-trisulfonate | 300 mg |
| N,N'—bis(2-hydroxybenzyl)ethylenediamine-N,N'—diacetic acid | 0.1 g |
| Nitrilo-N,N,N—trimethylene-phosphonic Acid (40 wt %) | 1.0 g |
| Potassium Bromide | 0.6 g |
| Additive | Shown in Table 4 |
| Sodium Sulfite | Shown in Table 4 |

-continued

| | |
|---|---|
| Potassium Carbonate | 30 g |
| N—ethyl-N—(β-methanesulfonamidoethyl)-3-methyl-4-aminoaniline Sulfate | 5.5 g |
| Fluorescent Whitening Agent (4,4'-Diaminostilbene type) | 1.0 g |
| Water to make | 1,000 ml |
| adjusted pH to 10.10 with KOH | |
| Bleach-fixing Solution: | |
| Ammonium Thiosulfate (70 wt %) | 150 ml |
| Sodium Sulfite | 15 g |
| Ammonium iron (III) ethylenediamine-tetraacetate | 60 g |
| Ethylenediaminetetraacetic Acid | 10 g |
| Fluorescent Whitening Agent (4,4'-Diaminostilbene type) | 1.0 g |
| 2-Mercapto-5-amino-3,4-thiadiazole | 1.0 g |
| Water to make | 1,000 ml |
| adjusted pH to 7.0 with aqueous ammonia | |
| Rinsing Solution: | |
| 5-Chloro-2-methyl-4-isothiazolin-3-one | 40 mg |
| 2-Methyl-4-isothiazolin-3-one | 10 mg |
| 2-Octyl-4-isothiazolin 3-one | 10 mg |
| Bismuth Chloride (40 wt %) | 0.5 g |
| Nitrilo-N,N,N—trimethylenephosphonic Acid (40 wt %) | 1.0 g |
| 1-Hydroxyethylidene-1,1-diphosphonic Acid (60 wt %) | 2.5 g |
| Fluorescent Whitening Agent (4,4'Diaminostibene type) | 1.0 g |
| Aqueous Ammonia (26 wt %) | 2.0 ml |
| Water to make | 1,000 ml |
| adjusted pH to 7.5 with KOH | |

Two kinds of the color developing solution having the above-mentioned composition were used, and one was a fresh solution immediately after prepared and the other was an aged solution which was left at 38° C. for one month after prepared.

$D_{min}$ and gradation of the cyan density were obtained by the use of the fresh solution and the aged solution, and the difference between the results with the aged solution and those with the fresh solution is shown in Table 4.

TABLE 4

| Sample No. | Cyan Coupler | Sodium Sulfite (g/l) | Additive (0.03 mol/l) | Change in Photographic Properties Dmin | Gradation | Remarks |
|---|---|---|---|---|---|---|
| 16 | C-5 | 1.8 | Hydroxylamine | +0.05 | +0.18 | Comparison |
| 17 | C-38 | 1.8 | Hydroxylamine | +0.06 | +0.15 | " |
| 18 | C-38 | — | Hydroxylamine | +0.07 | +0.11 | " |
| 19 | A* | 1.8 | (2) | +0.02 | +0.05 | The Invention |
| 20 | B* | 1.8 | (2) | +0.02 | +0.06 | " |
| 21 | C-5 | 1.8 | (2) | 0 | +0.03 | " |
| 22 | C-38 | 1.8 | (2) | 0 | +0.04 | " |
| 23 | A* | 0.2 | (2) | +0.02 | +0.02 | " |
| 24 | B* | 0.2 | (2) | +0.02 | +0.02 | " |
| 25 | C-5 | 0.2 | (2) | 0 | 0 | " |
| 26 | C-38 | 0.2 | (2) | 0 | 0 | " |
| 27 | A* | — | (2) | +0.02 | 0 | " |
| 28 | B* | — | (2) | +0.02 | 0 | " |
| 29 | C-5 | — | (2) | 0 | 0 | The Invention |
| 30 | C-38 | — | (2) | 0 | 0 | " |
| 31 | C-38 | — | (5) | 0 | −0.01 | " |
| 32 | C-38 | — | (7) | 0 | 0 | " |
| 33 | C-38 | — | (13) | 0 | 0 | " |

Note (*):
Cyan Coupler (A):

TABLE 4-continued

| Sample No. | Cyan Coupler | Sodium Sulfite (g/l) | Additive (0.03 mol/l) | Change in Photographic Properties Dmin | Gradation | Remarks |
|---|---|---|---|---|---|---|

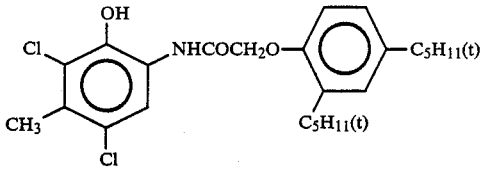

Cyan Coupler (B):

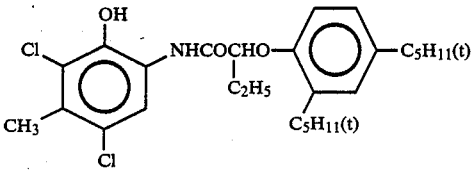

The results in Table 4 prove the following facts: When hydroxylamine was used, the formation of fog and the change of gradation were noticeable in the cases as processed with the aged solution (Sample Nos. 16 to 18). In contrast, the change in photographic properties was extremely reduced in the samples of the present invention (Sample Nos. 19 to 33).

In particular, when the cyan couplers of formula (C-I) or (C-II), which are preferred in the present invention, were used, the change in photographic properties was extremely remarkably reduced (Sample Nos. 21, 22, 25, 26, 29, 30, 31, 32, 33), and in addition, far better results were obtained when the concentration of sodium sulfite, which is generally used, was low (Sample Nos. 25, 26, 29, 30, 31, 32, 33).

EXAMPLE 5

The same treatment as Example 4 was carried out, except that Compound (C-10), (C-11), (C-25), (C-39) or (C-47) was used as the cyan coupler in place of (C-38) of Sample No. 22, 26, 30, 31, 32 or 33, and the variation of the photographic property was evaluated for the cases using the aged developer solution in the same manner as Example 4. As a result, it was apparent that the variation of the photographic property was far smaller in these cases than in the other cases where the Cyan Coupler (A) or (B), which is outside the scope of the Formulae (C-I) and (C-II), was used.

EXAMPLE 6

The color photographic paper samples as prepared in Example 1 were processed in accordance with the steps shown below using the color developing solution according to the present invention, conducting a running processing (continuous processing) test until the amount of replenisher reached three times of the tank capacity (60 liters) in every case, whereupon the composition of the color developing solution used was varied as shown in the following Table 5.

| Processing Steps | Temperature | Time | Amount of Replenisher |
|---|---|---|---|
| Color Development | 35° C. | 45 sec | 160 ml/m$^2$ |
| Bleach-fixing | 35° C. | 45 sec | 100 ml/m$^2$ |
| Rinsing (1) | 30° C. | 20 sec | — |
| Rinsing (2) | 30° C. | 20 sec | — |
| Rinsing (3) | 30° C. | 20 sec | 200 ml/m$^2$ |

-continued

| Processing Steps | Temperature | Time | Amount of Replenisher |
|---|---|---|---|
| Drying | 60 to 70° C. | 30 sec | |

The rinsing steps were carried out using a three-tank countercurrent system from Rinsing (3) to Rinsing (1).

The composition of each processing solution was as follows.

| | Tank Solution | Replenisher |
|---|---|---|
| Color Developing Solution | | |
| Triethanolamine | 8.0 g | 10.0 g |
| Additive | Shown in Table 5 | |
| Fluorescent Whitening Agent (4,4'-Diaminostilbene type) | 3.0 g | 4.0 g |
| Ethylenediamine-retraacetic Acid | 1.0 g | 1.5 g |
| Potassium Carbonate | 30.0 g | 30.0 g |
| Sodium Chloride | 1.4 g | 0.1 g |
| 4-Amino-3-methyl-N—ethyl-N—(β-(methanesulfonamido)ethyl)-aniline Sulfate | 5.0 g | 7.0 g |
| Benzyl Alcohol | Shown in Table 5 | |
| Diethylene Glycol | Shown in Table 5 | |
| 5-Methyl-7-hydroxy-3,4-triazaindolidine | 30 mg | — |
| Water to make | 1000 ml | 1000 ml |
| pH | 10.10 | 10.50 |

Bleach-fixing Solution (The composition was same in both the tank solution and the replenisher.)

| | |
|---|---|
| EDTA/FE (III)$NH_4.2H_2O$ | 60 g |
| EDTA.2Na.$2H_2O$ | 4 g |
| Ammonium Thiosulfate (70 wt %) | 120 ml |
| Sodium Sulfite | 16 g |
| Glacial Acetic Acid | 7 g |
| Water to make | 1000 ml |
| pH | 5.5 |

Rinsing Solution (The composition was same in both the tank solution and the replenisher.)

| | |
|---|---|
| EDTA.2Na.$2H_2O$ | 0.4 g |
| Water to make | 1000 ml |
| pH | 7.0 |

The blue density (B), the green density (G) and the red density (R) in an unexposed area of each sample were measured using a Fuji-type automatic recording densitometer for a sample at the start of the running processing and a sample at the end of the running processing. Further, the sample at the end of the running processing was stored at 60° C., 70%-RH for 2 months and then the densities of (B), (G) and (R) in unexposed area of each of the thus stored samples were once again measured The results obtained are set forth in Table 5.

TABLE 5

| Sample No. | Tank Solution Benzyl Alcohol (ml) | Tank Solution Diethylene Glycol (ml) | Replenisher Benzyl Alcohol (ml) | Replenisher Diethylene Glycol (ml) | Additive (0.04 mol/l) | Increment of Dmin (*) (End of Running Test) B | G | R | Increment of Dmin (*) (After stored at 60° C., 70% RH, for 2 months) B | G | R | Remarks |
|---|---|---|---|---|---|---|---|---|---|---|---|---|
| 34 | — | — | — | — | Hydroxylamine | +0.12 | +0.08 | +0.04 | +0.31 | +0.20 | +0.11 | Comparison |
| 35 | 15 | 10 | 20 | 10 | Hydroxylamine | +0.12 | +0.08 | +0.04 | +0.32 | +0.21 | +0.11 | " |
| 36 | — | — | — | — | (2) | +0.02 | 0 | 0 | +0.14 | +0.08 | +0.03 | The Invention |
| 37 | 15 | 10 | 20 | 10 | (2) | +0.11 | +0.06 | +0.03 | +0.28 | +0.18 | +0.05 | Comparison |
| 38 | — | — | — | — | (5) | +0.01 | 0 | 0 | +0.15 | +0.09 | +0.02 | The Invention |
| 39 | 15 | 10 | 20 | 10 | (5) | +0.10 | +0.06 | +0.03 | +0.27 | +0.16 | +0.04 | Comparson |
| 40 | — | — | — | — | (7) | +0.01 | 0 | 0 | +0.14 | +0.06 | +0.03 | The Invention |
| 41 | — | — | — | — | (10) | +0.01 | 0 | 0 | +0.13 | +0.07 | +0.02 | " |
| 42 | — | — | — | — | (13) | 0 | 0 | 0 | +0.14 | +0.06 | +0.01 | " |

Note (*) Increment of Dmin from the value on the starting of the running test.

As is apparent from the results shown in Table 5 above, the increase of stain with running processing could remarkably be suppressed in the color photographic paper samples processed by the process of the present invention and additionally the increase of stain under forced storage condition could also remarkably be suppressed in the samples processed by the process of the present invention (Sample Nos. 36, 38, 40, 41, 42).

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material containing a reflective support having thereon at least one light-sensitive silver halide emulsion layer, comprising: providing at least one light-sensitive silver halide emulsion layer which contains at least one cyan coupler represented by formula (C-I) or (C-II):

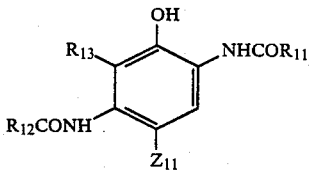

(C-I)

wherein $R_{11}$ is selected from the group consisting of an alkyl group, a cycloalkyl group, an aryl group, an amino group and a heterocyclic group; $R_{12}$ is selected from the group consisting of an alkyl group and an aryl group; $R_{13}$ is selected from the group consisting of a hydrogen atom, a halogen atom, an alkyl group and an alkoxy group; or $R_{13}$ may be bonded to $R_{12}$ to form a ring; and $Z_{11}$ is selected from the group consisting of a hydrogen atom, a halogen atom and a group capable of being released by the reaction with the oxidation product of an aromatic primary amine color developing agent;

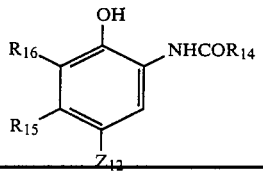

(C-II)

wherein $R_{14}$ is selected from the group consisting of an alkyl group, a cycloalkyl group, an aryl group and a heterocyclic group; $R_{15}$ represents an alkyl group having two or more carbon atoms; $R_{16}$ is selected from the group consisting of hydrogen atom, a halogen atom and an alkyl group; and $Z_{12}$ is selected from the group consisting of a hydrogen atom, a halogen atom and a group capable of being released by the reaction with the oxidation product of an aromatic primary amine color developing agent;

and, after image-wise exposing, developing said silver halide color photographic material with a color developing solution which (a) does not substantially contain benzyl alcohol, (b) contains sulfite in an amount of from about 0 g/l to about 1 g/l, (c) contains an aromatic primary amine color developing agent represented by formula (A):

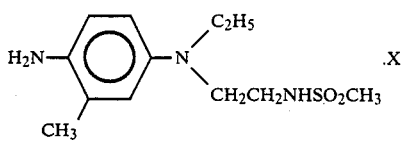

(A)

wherein X represents a compound capable of forming a salt with a primary amine, and (d) contains a compound represented by formula (I):

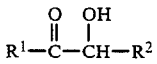

(I)

wherein $R^1$ is selected from the group consisting of a hydrogen atom, an alkyl group which may be substituted, an aryl group which may be substituted, an alkoxy group which may be substituted, an aryloxy group which may be substituted, and an amino group which may be substituted; and $R^2$ is selected from the group consisting of a hydrogen atom, an alkyl group which may be substituted and an aryl group which may be substituted; or $R^1$ and $R^2$ may be bonded to each other to form a carbon ring or a heteroring.

2. A method for processing a silver halide color photographic material according to claim 1, wherein the cyan coupler is represented by formula (C-II).

3. A method for processing a silver halide color photographic material as claimed in claim 1, wherein X in formula (A) is selected form the group consisting of sulfates, hydrochlorides, oxalates, phosphates, p-toluenesulfonate, and nitrates.

4. A method for processing a silver halide color photographic material as claimed in claim 1, wherein said aromatic primary amine color developing agent is incorporated in said color developing solution in an amount of from about 0.1 g/liter to about 20 g/liter.

5. A method for processing a silver halide color photographic material as claimed in claim 4, wherein said aromatic primary amine color developing agent is incorporated in said color developing solution in an amount of from about 0.5 g/liter to about 10 g/liter.

6. A method for processing a silver halide color photographic material as claimed in claim 1, wherein $R^1$ in formula (I) is an alkyl group, an alkoxy group or an amino group.

7. A method for processing a silver halide color photographic material as claimed in claim 1, wherein $R^2$ in formula (I) is a hydrogen atom or an alkyl group.

8. A method for processing a silver halide color photographic material as claimed in claim 1, wherein said compound of formula (I) is incorporated in said color developing solution in an amount of from about 0.1 g/liter to about 20 g/liter.

9. A method for processing a silver halide color photographic material as claimed in claim 8, wherein said compound of formula (I) is incorporated in said developing solution in an amount of from about 0.5 g/liter to about 10 g/liter.

10. A method for processing a silver halide color photographic material as claimed in claim 1, wherein $R_{11}$ in formula (C-I) is an aryl group or a heterocyclic group.

11. A method for processing a silver halide color photographic material as claimed in claim 1, wherein $R_{12}$ in formula (C-I) is a substituted or unsubstituted alkyl or aryl group and $R_{13}$ in formula (C-I) is a hydrogen atom.

12. A method for processing a silver halide color photographic material as claimed in claim 1, wherein $R_{14}$ in formula (C-II) is a substituted or unsubstituted alkyl or aryl group.

13. A method for processing a silver halide color photographic material as claimed in claim 1, wherein $R_{15}$ in formula (C-II) is an alkyl group having from 2 to 15 carbon atoms or a methyl group substituted by at least one substituent with 1 or more carbon atoms selected from an arylthio group, an alkylthio group, an acylamino group, an aryloxy group, and an alkyloxy group.

14. A method for processing a silver halide color photographic material as claimed in claim 1, wherein $R_{16}$ in formula (C-II) is a hydrogen atom or a halogen atom.

15. A method for processing a silver halide color photographic material as claimed in claim 1, wherein $Z_{11}$ and $Z_{12}$ in formulae (C-I) and (C-II) each is a hydrogen atom, a halogen atom, an alkoxy group, an aryloxy group, an acyloxy group or a sulfonamido group.

16. A method for processing a silver halide color photographic material as claimed in claim 1, wherein said color developing solution does not contain hydroxylamine.

17. A color developing solution comprising an aromatic primary amine color developing agent represented by formula (A);

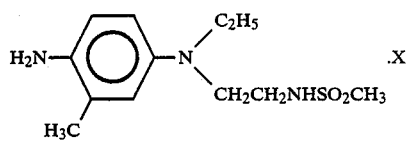

(A)

wherein x represents a compound capable of forming a salt with a primary amine; a compound represented by formula (I):

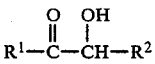

(I)

wherein $R^1$ represents a hydrogen atom or a substituted or unsubstituted alkyl, aryl, alkoxy, aryloxy or amino group; and $R^2$ represents a hydrogen atom or a substituted or unsubstituted alkyl or aryl group; or $R^1$ and $R^2$ may be bonded to each other to form a carbon ring or a heteroring; and a benzyl alcohol in an amount of 0 to not more than about 2 ml per liter of said developing solution.

18. A color developing solution as claimed in claim 17, wherein $R^1$ in formula (I) is an alkyl group, an alkoxy group or an amino group.

19. A color developing solution as claimed in claim 17, wherein $R^2$ in formula (I) is a hydrogen atom or an alkyl group.

20. A color developing solution as claimed in claim 17, wherein said compound of formula (I) is incorporated in said color developing solution in an amount of from about 0.1 g/liter to about 20 g/liter.

21. A color developing solution as claimed in claim 17, wherein said color developing solution does not contain hydroxylamine.

22. A method for processing a silver halide color photographic material according to claim 1, wherein said color developing solution contains sulfite in an amount of from 0 g to 0.5 g per liter of developing solution.

23. A method for processing a silver halide color photographic material according in claim 1, wherein the processing time is from about 30 seconds to 2 minutes.

24. A method for processing a silver halide color photographic material according to claim 1, wherein said material contains cyan couplers represented by formula (C-I) and (C-II) in combination.

25. A method for processing a silver halide color photographic material according to claim 1, wherein said light-sensitive silver halide emulsion comprises a silver chlorobromide emulsion containing at least about 60 mol % of silver chloride.

26. A method for processing a silver halide color photographic material according to claim 1, wherein said light-sensitive silver halide emulsion has a silver chloride content of from about 80 to 100 mol %.

* * * * *